US009952536B2

(12) United States Patent
Takahashi et al.

(10) Patent No.: US 9,952,536 B2
(45) Date of Patent: Apr. 24, 2018

(54) DEVELOPING APPARATUS HAVING DEVELOPER DISTRIBUTION CONTROL

(71) Applicant: CANON KABUSHIKI KAISHA, Tokyo (JP)

(72) Inventors: Kyosuke Takahashi, Toride (JP); Atsushi Matsumoto, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/128,487

(22) PCT Filed: May 22, 2015

(86) PCT No.: PCT/JP2015/002605
§ 371 (c)(1),
(2) Date: Sep. 23, 2016

(87) PCT Pub. No.: WO2015/178040
PCT Pub. Date: Nov. 26, 2015

(65) Prior Publication Data

US 2017/0123349 A1 May 4, 2017

(30) Foreign Application Priority Data

May 23, 2014 (JP) ..... 2014-107571
May 23, 2014 (JP) ..... 2014-107574

(51) Int. Cl.
*G03G 15/08* (2006.01)

(52) U.S. Cl.
CPC ..... *G03G 15/0891* (2013.01); *G03G 15/0812* (2013.01); *G03G 15/0846* (2013.01);
(Continued)

(58) Field of Classification Search
CPC ..... G03G 15/0891; G03G 15/0812; G03G 15/0846; G03G 15/0893; G03G 15/0889;
(Continued)

(56) References Cited

U.S. PATENT DOCUMENTS 8,355,655 B2 1/2013 Sakamaki
8,385,754 B2 2/2013 Hirobe et al.
(Continued)

FOREIGN PATENT DOCUMENTS

EP 2 273 318 A2 1/2011
JP 2002214890 A * 7/2002
(Continued)

OTHER PUBLICATIONS

European Search Report dated Dec. 17, 2017, in related European Patent Application No. 15796296.0.

*Primary Examiner* — David M Gray
*Assistant Examiner* — Laura Roth
(74) *Attorney, Agent, or Firm* — Fitzpatrick, Cella, Harper & Scinto

(57) ABSTRACT

An image forming apparatus includes an image forming portion having a first feeding member to feed developer in a first chamber, a second feeding member to feed the developer in a second chamber; and a control portion to execute a plurality of modes by suspending image forming. A first mode circulates the developer in a condition in which a ratio of a rotational speed of the developer bearing member to a rotational speed of the first and second feeding members is decreased as compared to that in forming the images; and a second mode increases the ratio of the rotational speed of the developer bearing member to the rotational speed of the first feeding member as compared to that in forming the images. The second mode is executed after the first mode and before resuming the image forming operation.

6 Claims, 16 Drawing Sheets

(52) U.S. Cl.
CPC ..... *G03G 15/0893* (2013.01); *G03G 15/0889* (2013.01); *G03G 2215/0819* (2013.01)

(58) Field of Classification Search
CPC ..... G03G 15/0824; G03G 2215/0819; G03G 2215/0827
See application file for complete search history.

(56) References Cited

U.S. PATENT DOCUMENTS

| | | | | |
|---|---|---|---|---|
| 8,649,714 | B2 | 2/2014 | Kudo et al. | |
| 9,164,459 | B2 | 10/2015 | Suzuki | |
| 9,250,570 | B2 | 2/2016 | Matsumoto | |
| 9,274,481 | B2 | 3/2016 | Takahashi | |
| 2006/0127133 | A1 | 6/2006 | Suzuki | |
| 2009/0232531 | A1* | 9/2009 | Tonohiro | G03G 15/0806 399/53 |
| 2009/0290886 | A1 | 11/2009 | Murauchi et al. | |
| 2010/0098447 | A1* | 4/2010 | Ootsuka | G03G 15/0848 399/53 |
| 2011/0026959 | A1 | 2/2011 | Itaya | |
| 2011/0052221 | A1* | 3/2011 | Hirobe | G03G 15/0877 399/27 |
| 2012/0070165 | A1* | 3/2012 | Suzuki | G03G 15/556 399/27 |
| 2012/0155900 | A1* | 6/2012 | Suzuki | G03G 15/0877 399/53 |

FOREIGN PATENT DOCUMENTS

| | | | |
|---|---|---|---|
| JP | 2005-010558 | A | 1/2005 |
| JP | 2010-152098 | A | 7/2010 |
| JP | 2011-048117 | A | 3/2011 |
| JP | 2011-053451 | A | 3/2011 |
| JP | 2012-053155 | A | 3/2012 |
| JP | 2012-068390 | A | 4/2012 |
| JP | 2012-194351 | A | 10/2012 |
| JP | 2013054106 | A * | 3/2013 |
| JP | 2013-088687 | A | 5/2013 |

* cited by examiner

[Fig. 1]
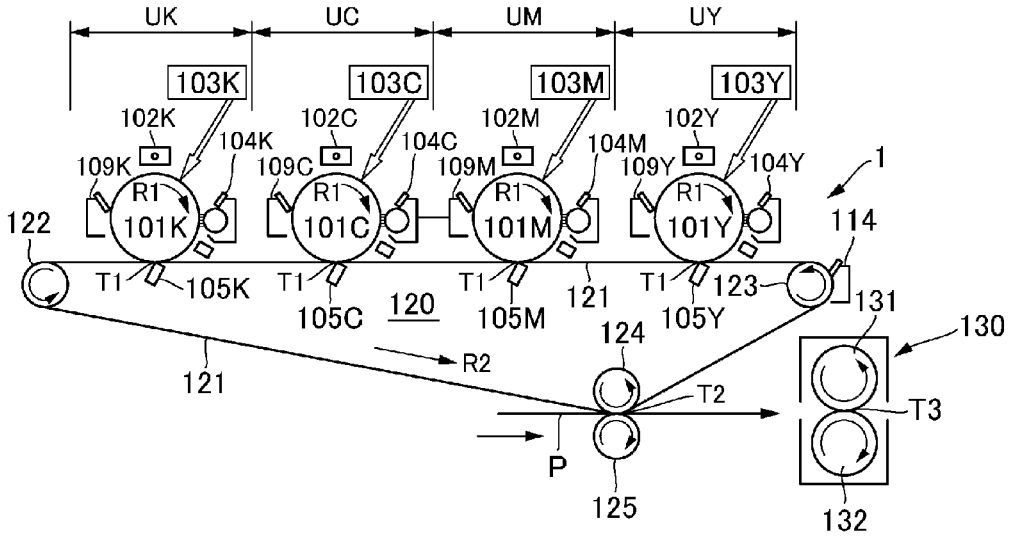

[Fig. 2]
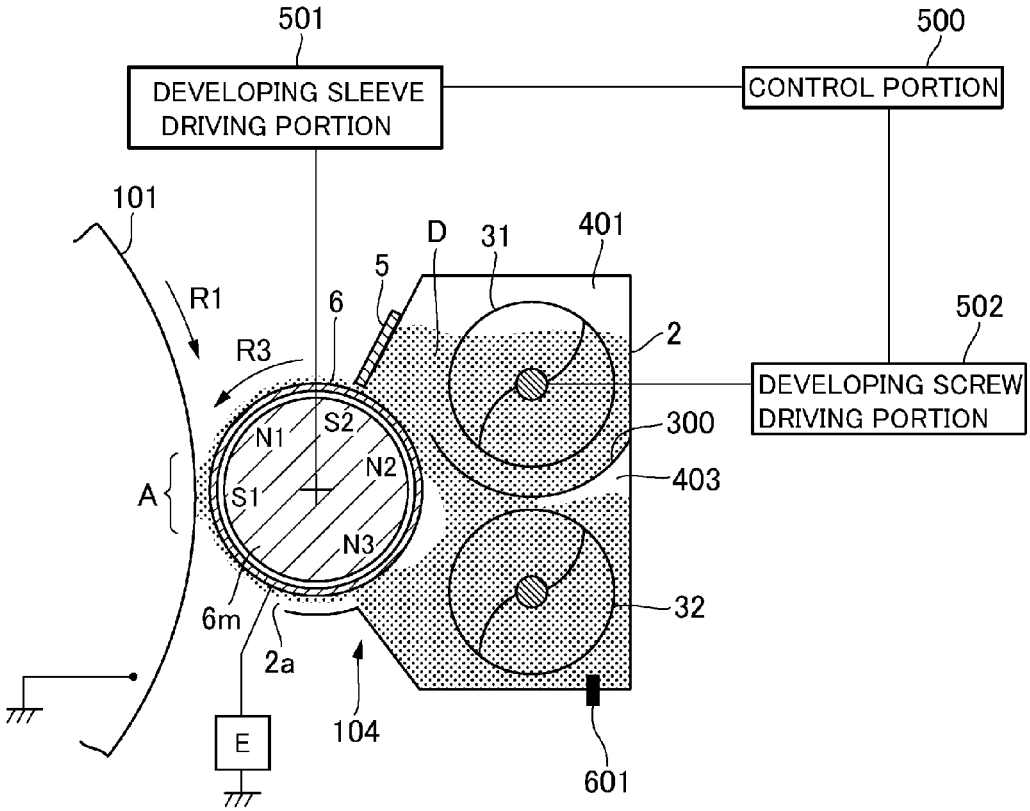

[Fig. 3]
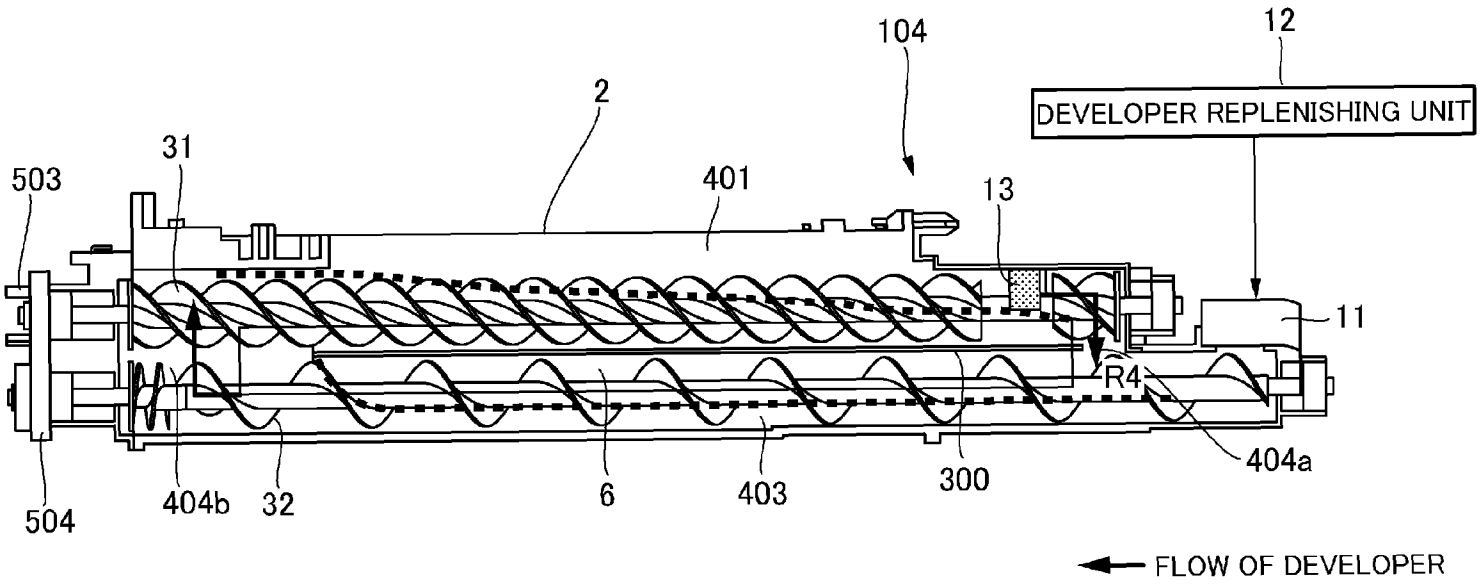

[Fig. 4]
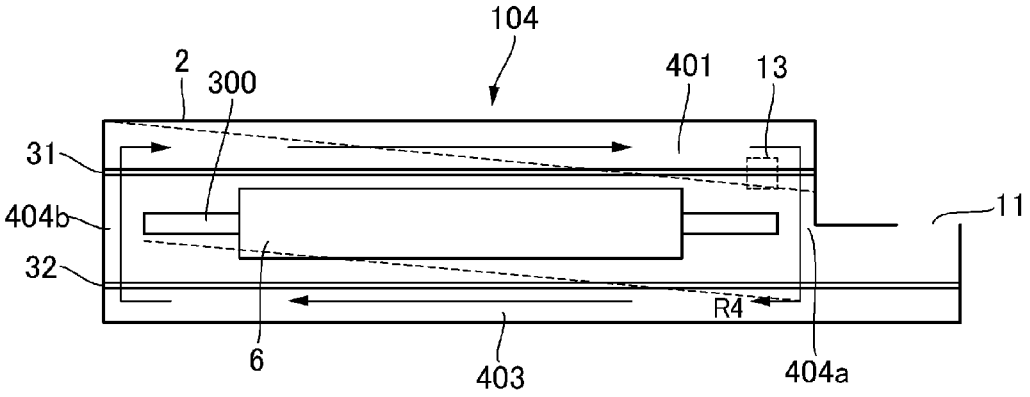

[Fig. 5]
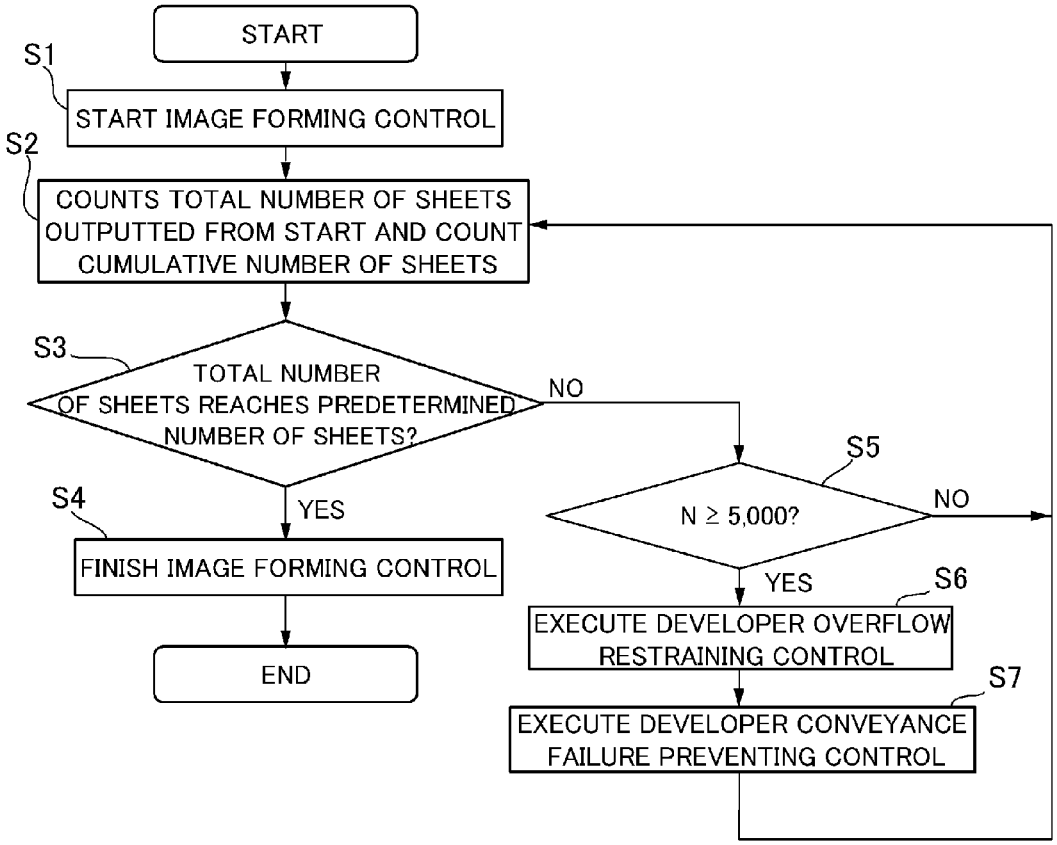

[Fig. 6]
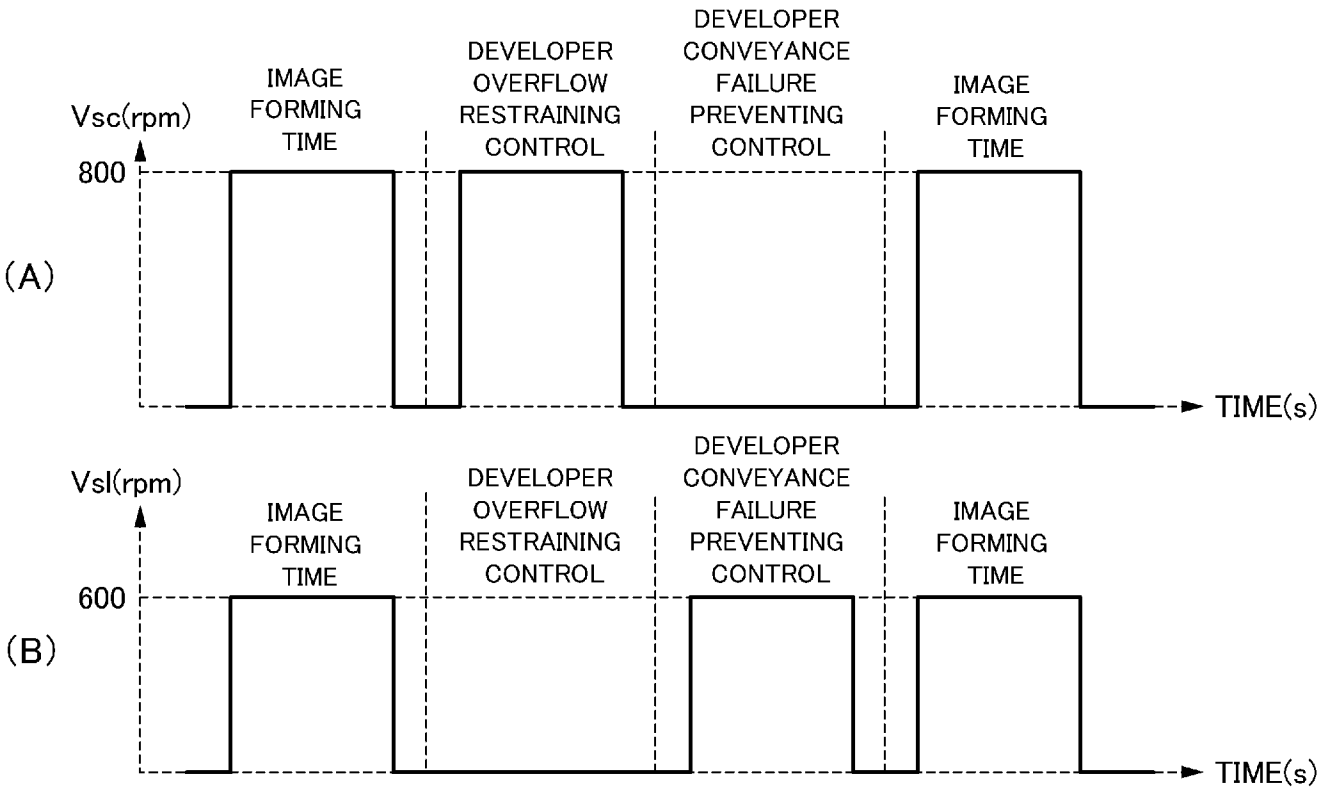

[Fig. 7]
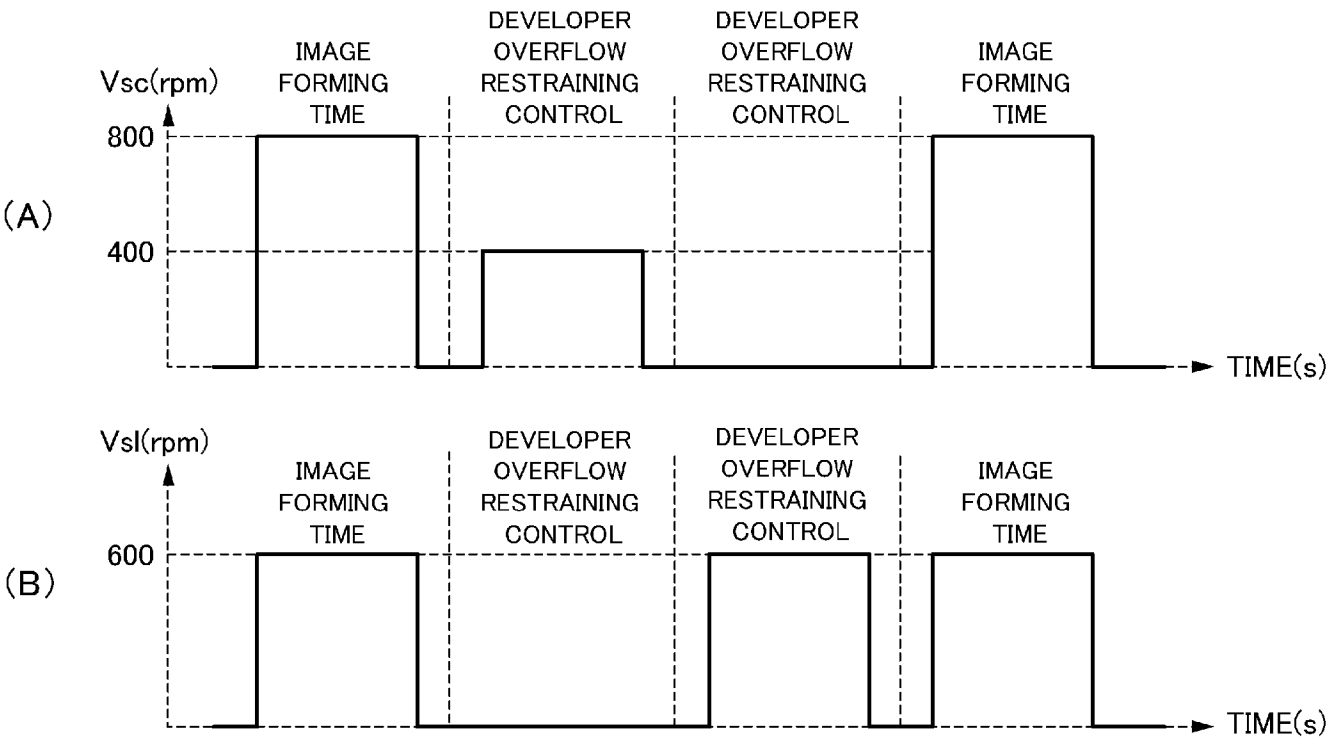

[Fig. 8]
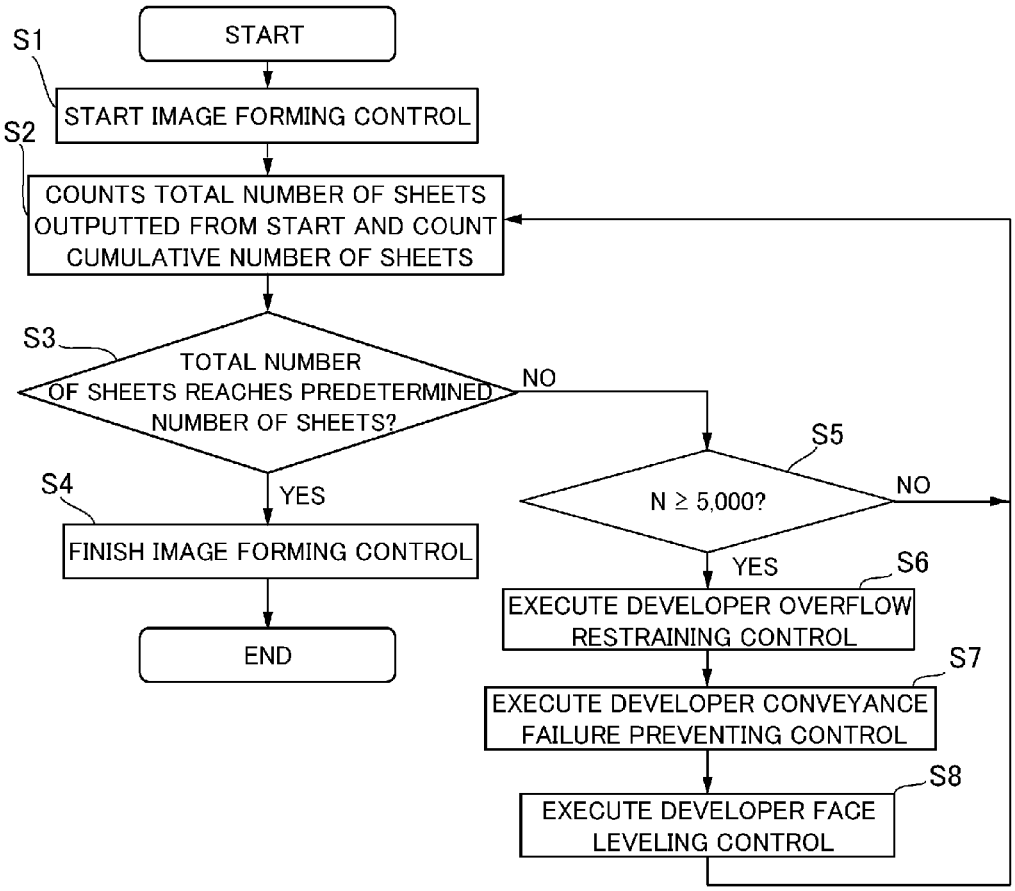

[Fig. 9]
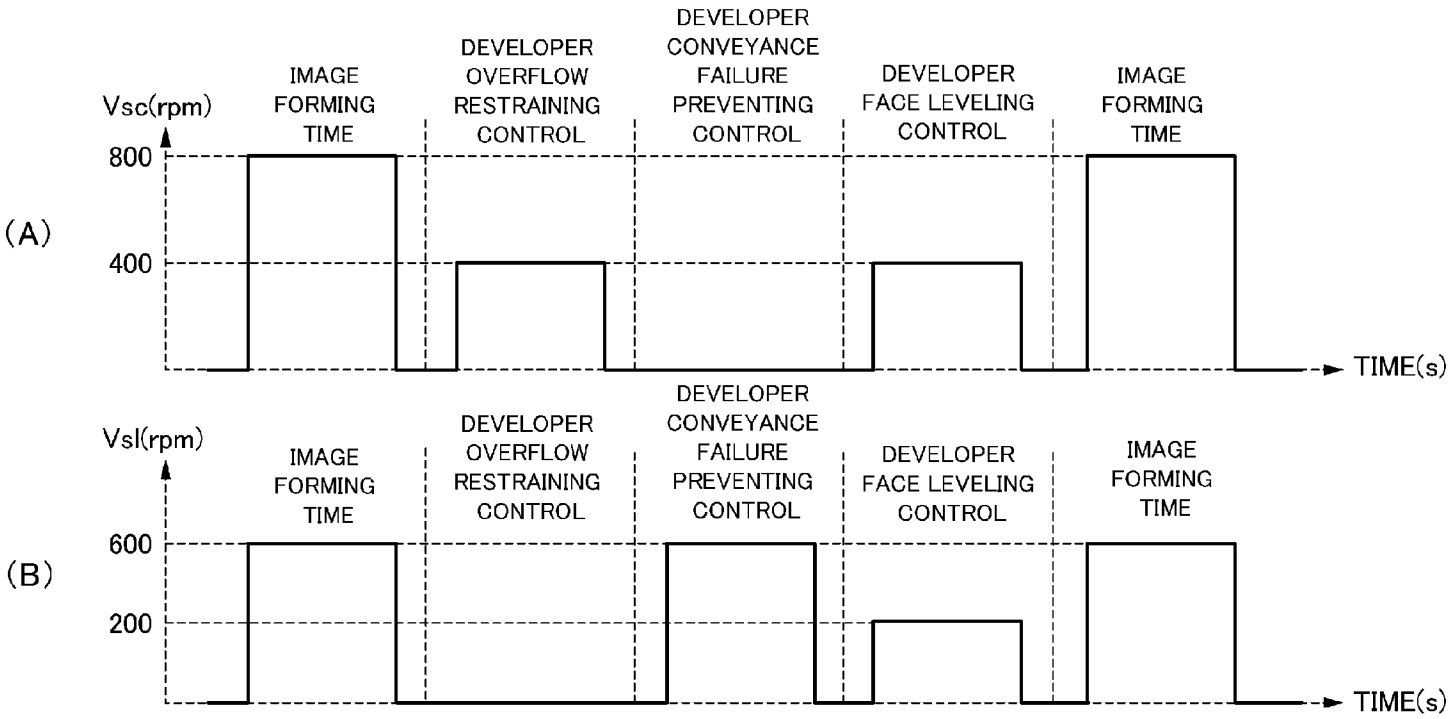

[Fig. 10]
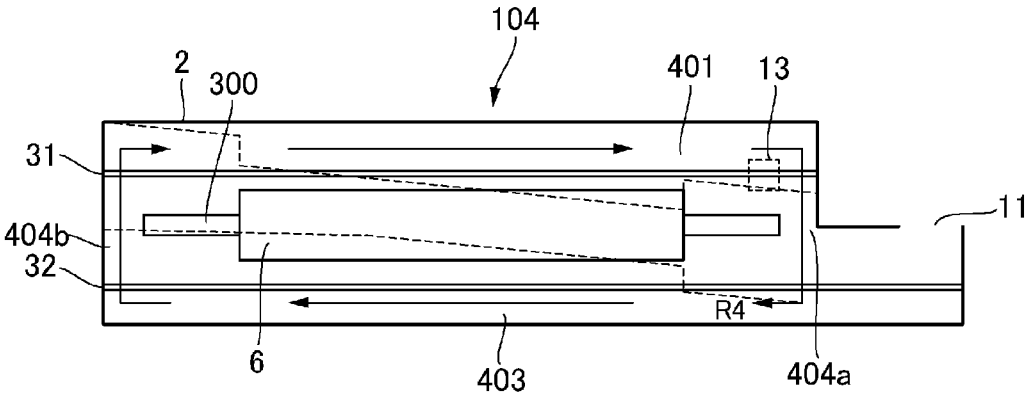

[Fig. 11]
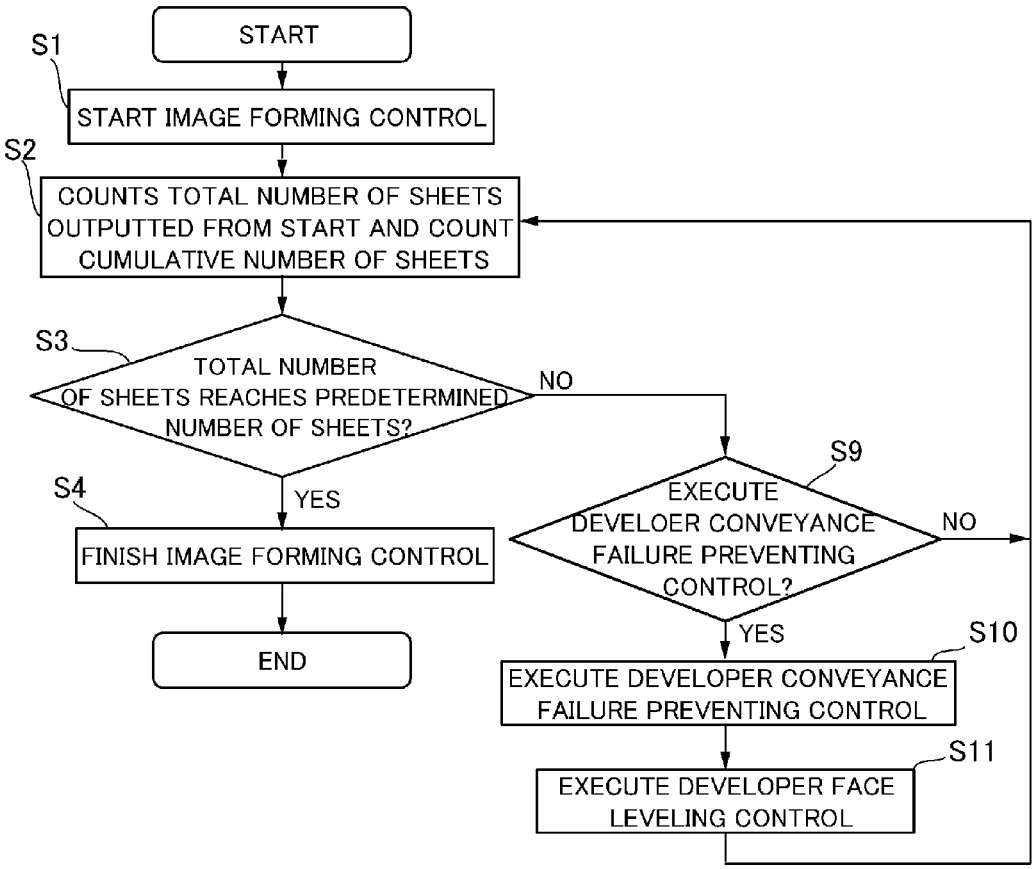

[Fig. 12]
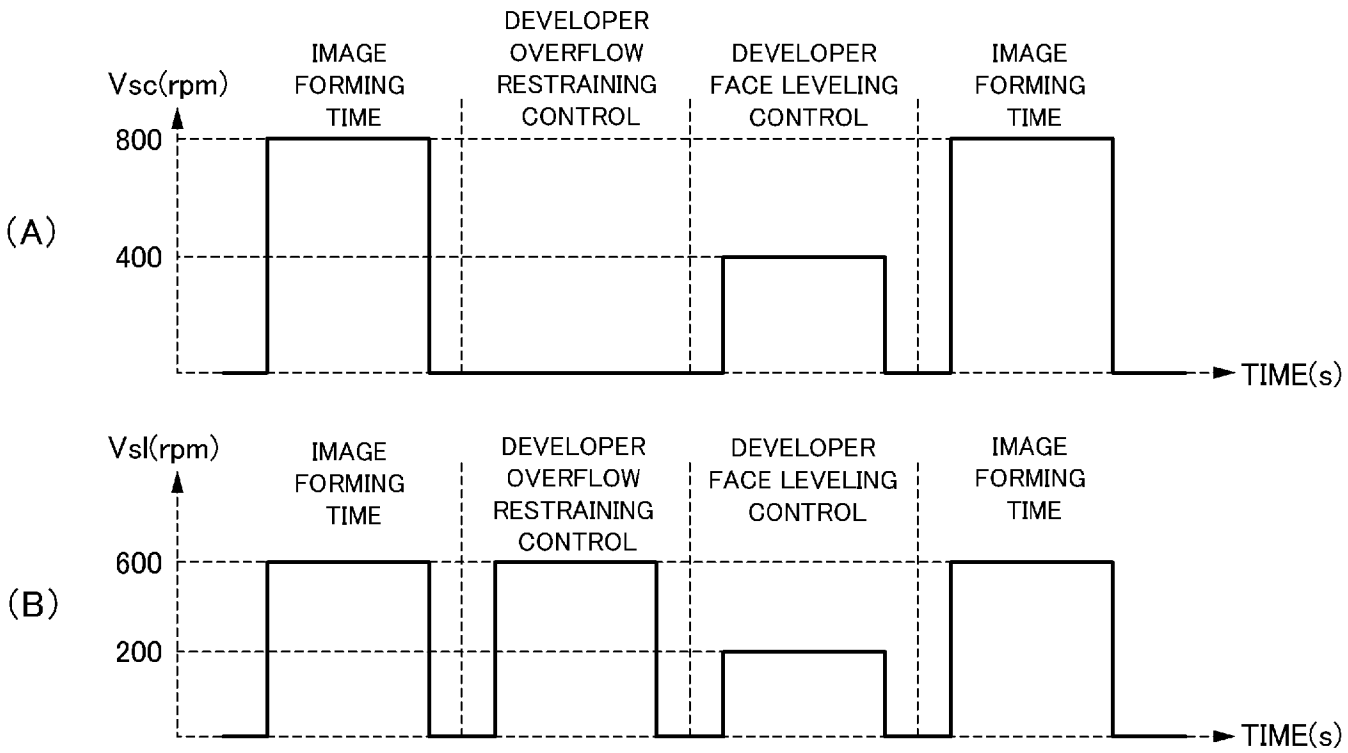

[Fig. 13]
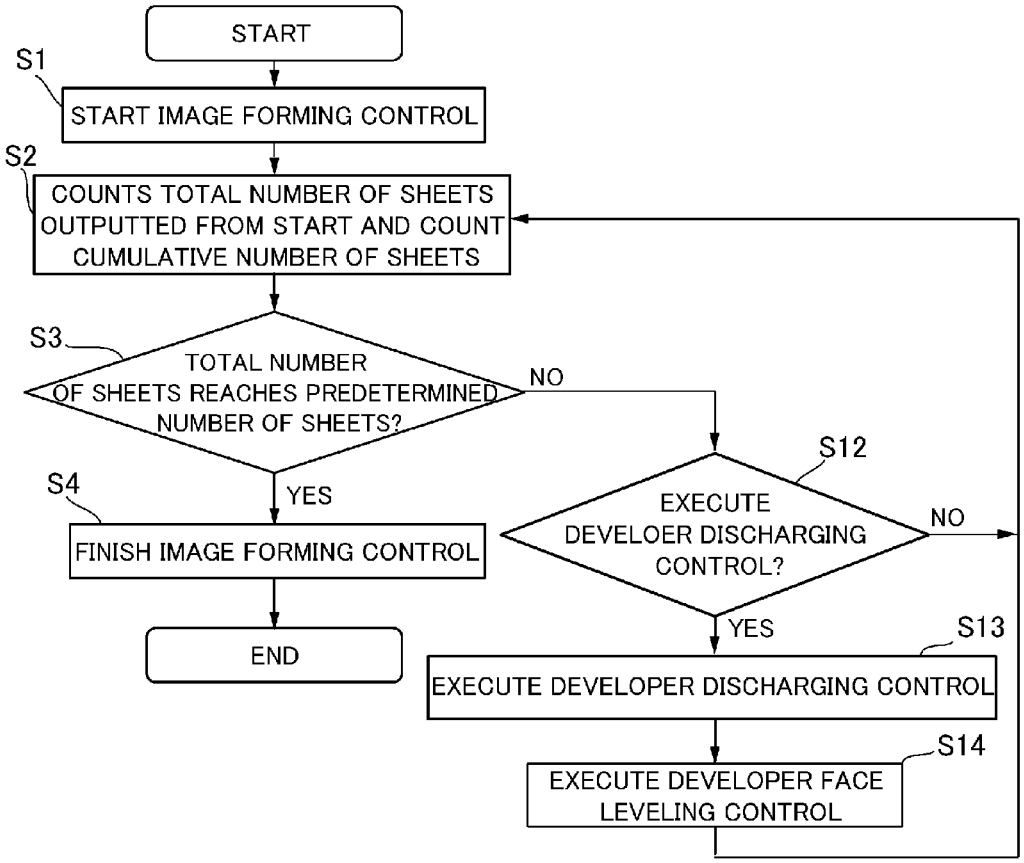

[Fig. 14]
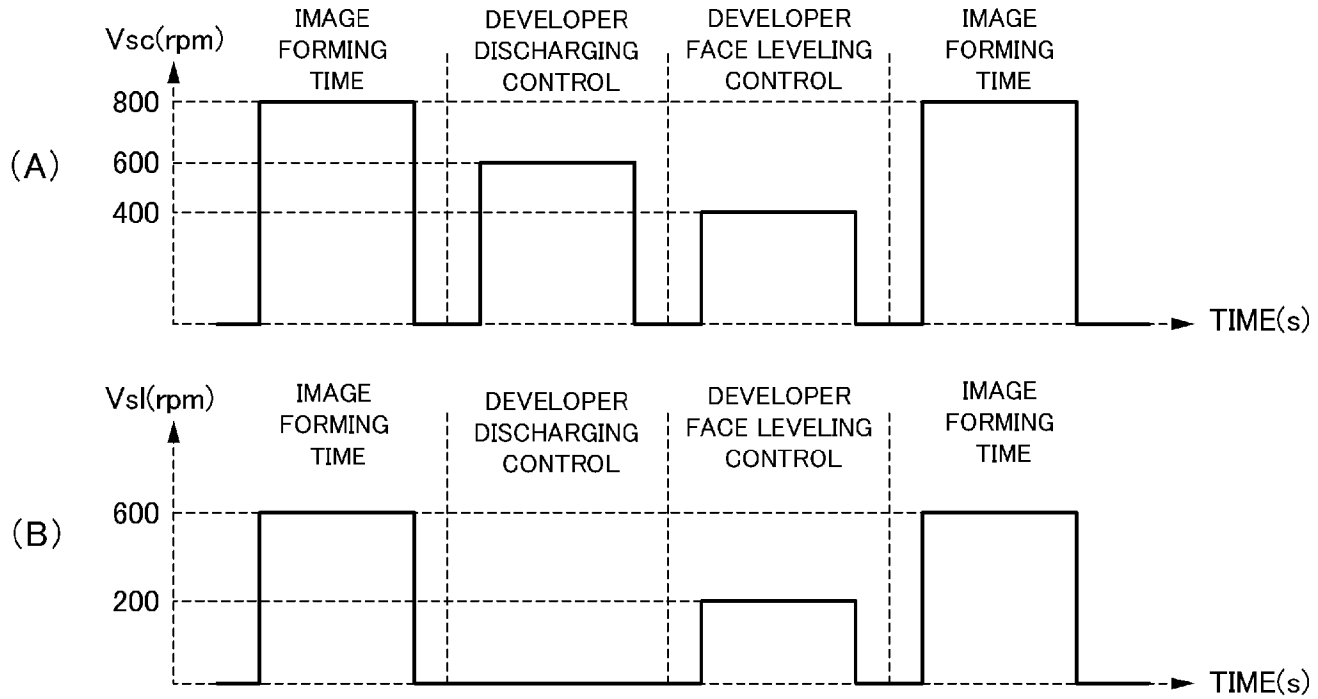

[Fig. 15]
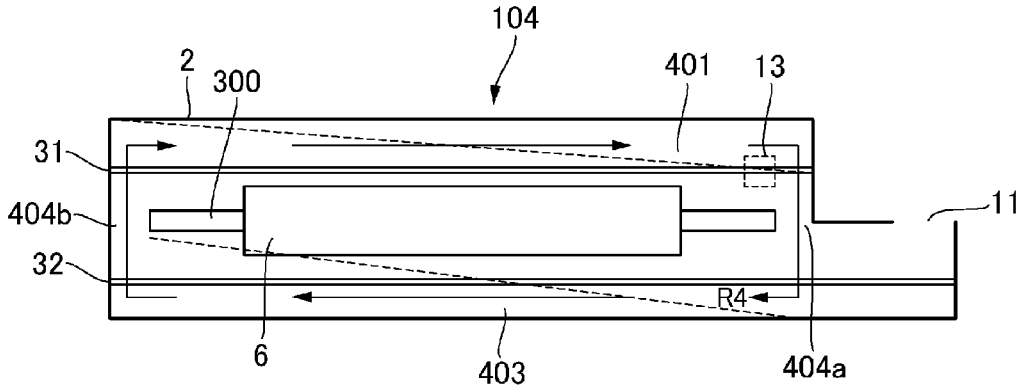

[Fig. 16]
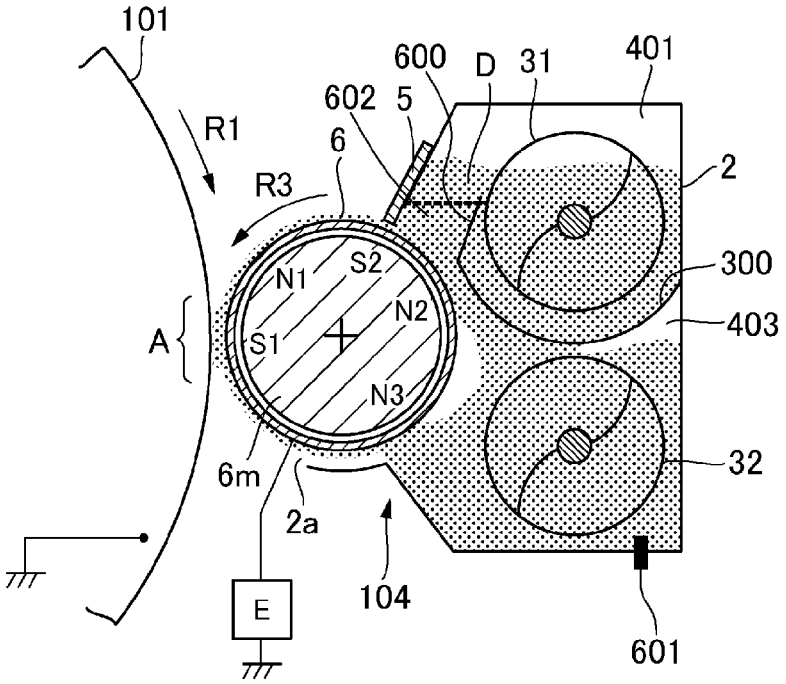

DEVELOPING APPARATUS HAVING DEVELOPER DISTRIBUTION CONTROL

TECHNICAL FIELD

The present invention relates to a developing apparatus developing an image by using a developer.

BACKGROUND ART

An image forming apparatus such as a copier, a printer, a facsimile, and a multi-function printer having a plurality of functions of such apparatuses using an electro-photographic or electrostatic recording system is configured to visualize (develop) an image by applying developer to an electrostatic latent image formed on an image carrier such as a photosensitive drum. Conventionally, some developing apparatuses used in such development are known to use two-component developer (referred to simply as 'developer' hereinafter) composed of toner, i.e., non-magnetic particles, and carrier, i.e., magnetic particles.

In such a developing apparatus, the developer is carried on a surface of a developing sleeve and is conveyed as the developing sleeve rotates. While being regulated in amount (layer thickness) by a regulating blade, i.e., a developer regulating member, disposed in close proximity with the developing sleeve, the developer is conveyed to a developing area facing a photosensitive drum. Then, an electrostatic latent image formed on the photosensitive drum is developed by the toner within the developer.

Here, as the developing apparatus, there is well known a developing apparatus having a so-called function separated type configuration including a supply chamber (first chamber) supplying the developer to the developing sleeve and a recovery chamber (second chamber) recovering the developer from the developing sleeve. There is also known a developing apparatus having a so-called carrier refreshing configuration of replenishing new developer and of discharging extra developer from a discharge port because the carrier deteriorates and drops its charging performance during its use. A configuration of executing the following control is known as the function separated type developing apparatus having the carrier refreshing configuration.

For instance, Japanese Patent Application Laid-open No. 2011-53451 proposes an arrangement (mode) of reducing a ratio of rotational speed Vsc of a conveying screw circularly conveying the developer in the supply and recovery chambers and rotational speed Vsl of the developing sleeve in order to remove a toner layer generated at an upstream location of the regulating blade. That is, if the image forming operations are carried out continuously, toner deposits upstream of the regulating blade, thus forming the toner layer. Because the toner layer narrows down a gap between the developing sleeve and the regulating blade, it causes a conveyance failure hampering the supply of the developer to the developing sleeve. Then, Japanese Patent Application Laid-open No. 2011-53451 proposes to remove the toner layer by temporarily interrupting the image forming operation and by executing the above-mentioned control (mode) when the image forming operations are continuously carried out.

Still further, Japanese Patent Application Laid-open No. 2010-152098 proposes a control (mode) of driving the conveying screw while retarding the rotational speed of the developing sleeve to be slower than that during the image forming operation in order to restrain the developer from overflowing out of the developing apparatus even if the developer is unevenly distributed in one chamber of the supply and recover chambers. For instance, in a case of a configuration in which the recovery chamber is disposed under the supply chamber in the function separated type developing apparatus, the developer is liable to be unevenly distributed in the recovery chamber. If the developer is tried to be recovered to the recovery chamber from the developing sleeve in such state, there is a possibility that the developer overflows out of the recovery chamber. Then, Japanese Patent Application Laid-open No. 2010-152098 conveys the developer from the recovery chamber to the supply chamber and discharges the developer forcibly from a discharge port of the supply chamber by executing the above-mentioned control (mode) in forming no image.

However, there is a case when it is unable to fully restrain the toner layer from being generated upstream of the regulating blade even if the developing sleeve and conveying screws are driven in forming no image in driving conditions different from those in forming an image as disclosed in Japanese Patent Application Laid-open No. 2011-53451. Then, there is a need for a developing apparatus capable of fully restraining the toner layer from being generated upstream of the regulating blade with a simple structure.

Still further, when the controls (modes) described in the above-mentioned Japanese Patent Application Laid-open Nos. 2011-53451 and 2010-152098 are executed, the distribution of the developer in the supply and recovery chambers are differentiated from a normal distribution. That is, in the case when the control (mode) described in Japanese Patent Application Laid-open No. 2011-53451 is executed, the distribution of the developer becomes different and the developer is stored more in the recovery chamber than the supply chamber, differing from the distribution in forming an image. Still further, as compared to a stationary state, i.e., the distribution of the developer in forming an image, spots where a developer face level has risen are partly generated. If an image is started to be formed in this condition, the developer at the spots in which the developer face level has risen is very likely to be conveyed to the discharge port without collapsing, thus possibly ending up being excessively discharged.

Still further, if the control (mode) described in Japanese Patent Application Laid-open No. 2010-152098 is executed, a height of the developer face level in the supply chamber increases, so that there is also a possibility of discharging the developer excessively from the discharge port of the supply chamber if an image is formed as it is.

For the foregoing reasons, there is a need for a developing apparatus capable of restraining such troubles otherwise caused by such control of disturbing the distribution of the developer face level within the supply and recovery chambers in forming no image, even when such controls (mode) are executed.

SUMMARY OF INVENTION

According to a first aspect of the invention, a developing apparatus includes a developer carrier carrying and conveying developer, a first chamber provided to face a circumferential surface of the developer carrier and supplying the developer to the developer carrier, a second chamber provided to face the circumferential surface of the developer carrier, communicating with the first chamber to form a circulating route of the developer and to pass the developer with the first chamber, and recovering the developer carried on the developer carrier, a conveying portion circularly conveying the developer in the circulating route, and a control portion executing a mode of controlling rotational speeds of the conveying portion and the developer carrier in forming no image such that a ratio of rotational speeds (Vsc/Vsl) increases as compared to the ratio of rotational speeds in forming an image, and the ratio of rotational speeds (Vsc/Vsl) decreases as compared to the ratio of rotational speeds in forming the image after increasing the ratio of rotational speeds, where Vsc is the rotational speed of the conveying portion and Vsl is the rotational speed of the developer carrier.

According to a second aspect of the invention, a developing apparatus includes a developer carrier carrying and conveying developer, a first chamber provided to face a circumferential surface of the developer carrier and supplying the developer to the developer carrier, a second chamber provided to face the circumferential surface of the developer carrier, communicating with the first chamber to form a circulating route of the developer and to pass the developer with the first chamber, and recovering the developer carried on the developer carrier, a conveying portion circularly conveying the developer in the circulating route, and a control portion executing a control of circulating the developer between the first and second chambers by driving the conveying portion and the developer carrier, for a predetermined period of time, at rotational speeds lower than those in forming an image after executing a control of driving the conveying portion and the developer carrier while differentiating a relationship between rotational speeds of the conveying portion and of the developer carrier in forming no image from that in forming the image.

Still further, according to a third aspect of the invention, a developing apparatus includes a developer carrier carrying and conveying developer, a first chamber provided to face a circumferential surface of the developer carrier and supplying the developer to the developer carrier, a second chamber provided to face the circumferential surface of the developer carrier, communicating with the first chamber to form a circulating route of the developer and to pass the developer with the first chamber, and recovering the developer carried on the developer carrier, a conveying portion circularly conveying the developer in the circulating route, a regulating member disposed to face the developer carrier and regulating the developer to be carried on the developer carrier, a back-up member forming a buffer portion for temporarily storing the developer between the first chamber and the regulating member, and a control portion executing a mode of controlling rotational speeds and rotation times of the conveying portion and the developing sleeve in forming no image such that a ratio of the rotational speeds (Vsc/Vsl) decreases as compared to the ratio in forming an image until when a volume of the developer occupying in the buffer portion becomes at least less than 50% of a volume of the buffer portion, where Vsc is the rotational speed of the conveying portion and Vsl is the rotational speed of the developer carrier.

Further features of the present invention will become apparent from the following description of exemplary embodiments with reference to the attached drawings.

BRIEF DESCRIPTION OF DRAWINGS

FIG. 1 is a schematic diagram illustrating a configuration of an image forming apparatus to which a developing apparatus of a first embodiment is applied.

FIG. 2 is a schematic section view illustrating a configuration of the developing apparatus in terms of a cross-section thereof perpendicular to an axis of a developing sleeve of the developing apparatus.

FIG. 3 is a section view illustrating the configuration in terms of a vertical cross-section thereof containing.

FIG. 4 illustrates a distribution of the developer in forming an image.

FIG. 5 is a flowchart in performing an image forming job of the first embodiment.

FIG. 6 illustrates motions of (A) the conveying screw, and (B) the developing sleeve in the image forming job of the first embodiment.

FIG. 7 illustrates motions of (A) the conveying screw, and (B) the conveying screw in a developer overflow restraining control of a second embodiment.

FIG. 8 is a flowchart of an image forming job of a third embodiment.

FIG. 9 illustrates motions of (A) the conveying screw, and (B) the developing sleeve in the image forming job of the third embodiment.

FIG. 10 illustrates a distribution of the developer after making a conveyance failure preventing control.

FIG. 11 is a flowchart of an image forming job of a modified example in which no developer overflow restraining control is executed.

FIG. 12 illustrates motions of (A) the conveying screw, and (B) the developing sleeve in the image forming job of the modified example.

FIG. 13 is a flowchart of an image forming job of a fourth embodiment.

FIG. 14 is a timing chart illustrating motions of (A) the conveying screw, and (B) the developing sleeve in the image forming job of the fourth embodiment.

FIG. 15 illustrates a distribution of the developer after executing a developer discharge control.

FIG. 16 is a section view illustrating a configuration of the developing apparatus of the fourth embodiment.

DESCRIPTION OF EMBODIMENTS

<First Embodiment>

A first embodiment of a developing apparatus will be described below with reference to FIGS. 1 through 5. While the developing apparatus of the present embodiment will be applied to an image forming apparatus described below, the present invention is not limited to such arrangement and is applicable to another image forming apparatus. That is, the developing apparatus of the present embodiment can be carried out in any image forming apparatus regardless of whether it is a tandem type or one drum type, or of an intermediate transfer type or a direct transfer type. It is also noted that while only a main part related to formation and/or transfer of a toner image will be described in the present embodiment, the present invention can be carried out in various uses such as a printer, various printing machines, a copier, a facsimile and a multi-function printer.

Image Forming Apparatus

Firstly, a schematic structure of the image forming apparatus to which the developing apparatus of the present embodiment is applied will be described with reference to FIG. 1. FIG. 1 is a schematic diagram illustrating the structure of the image forming apparatus to which the developing apparatus of the present embodiment is applied. The image forming apparatus 1 illustrated in FIG. 1 is a tandem type intermediate transfer system full-color printer in which image forming portions UY, UM, UC and UK are arrayed along an intermediate transfer belt 121.

In the image forming portion UY, a yellow toner image is formed on a photosensitive drum 101Y and is then transferred to the intermediate transfer belt 121. In the image forming portion UM, a magenta toner image is formed on a photosensitive drum 101M and is transferred to the intermediate transfer belt 121. In the image forming portions UC and UK, cyan and black toner images are formed respectively on photosensitive drums 101C and 101K and are transferred to the intermediate transfer belt 121. The four color toner images transferred to the intermediate transfer belt 121 are conveyed to a secondary transfer portion T2 and are secondarily transferred collectively to a recording medium P (sheet member such as a sheet of paper and an OHP sheet).

The image forming portions UY, UM, UC and UK are constructed substantially identically except that the colors of the toners used in the developing apparatuses 104Y, 104M, 104C, and 104K are different as yellow, magenta, cyan, and black. Accordingly, the construction and operation of the image forming portion U will be collectively described below by denoting the image forming portion only by U from which Y, M, C, and K at the end of the respective reference signs discriminating the image forming portions UY, UM, UC and UK are omitted.

Disposed in the image forming portion U around the photosensitive drum 101, i.e., an image carrier, are a primary charger 102, an exposure unit 103, the developing apparatus 104, a transfer charger 105, and a drum cleaning unit 109. The photosensitive drum 101 is provided with a photosensitive layer around an outer circumferential surface of an aluminum-made cylinder and rotates in a direction of an arrow R1 with a predetermined process speed.

The primary charger 102 irradiates charged particles following corona discharge for example to electrify the photosensitive drum 101 with homogeneous negative dark part potential. The exposure unit 103 scans, by a rotational mirror, an ON-OFF modulated laser beam of scan line image data developed from a color separation image of each color to draw an electrostatic image of the image on a surface of the photosensitive drum 101. The developing apparatus 104 supplies toner to the photosensitive drum 101 to develop the electrostatic image as a toner image.

The transfer charger 105 is disposed so as to face the photosensitive drum 101 with the intermediate transfer belt 121 between them and forms a primary transfer portion T1 for primarily transferring the toner image between the photosensitive drum 101 and the intermediate transfer belt 121. In the primary transfer portion T1, the toner image is transferred from the photosensitive drum 101 to the intermediate transfer belt 121 by a transfer bias applied to the transfer charger 105. The drum cleaning unit 109 recovers transfer residual toner slightly left on the photosensitive drum 101 after the primary transfer by scrubbing the photosensitive drum 101 by a cleaning blade.

The intermediate transfer belt 121 is wrapped around and supported by such rollers as a driving roller 122, a tension roller 123, and a secondary transfer inner roller 124 and rotates in a direction of an arrow R2 in FIG. 1 by being driven by the driving roller 122. The secondary transfer portion T2 is a toner image transfer nip portion formed by bringing the intermediate transfer belt 121 stretched by the secondary transfer inner roller 124 into contact with a secondary transfer outer roller 125 to transfer the toner image to a recording medium P. In the secondary transfer portion T2, the toner image is secondarily transferred from the intermediate transfer belt 121 to the recording medium P, conveyed to the secondary transfer portion T2, by a secondary transfer bias applied to the secondary transfer outer roller 125. After the secondary transfer, transfer residual toner adhering on the intermediate transfer belt 121 is recovered by a belt cleaning unit 114 scrubbing the intermediate transfer belt 121.

The recording medium P on which the four color toner images have been secondarily transferred by the secondary transfer portion T2 is then conveyed to a fixing apparatus 130. The fixing apparatus 130 forms a transfer nip T3 by fixing rollers 131 and 132 being in contact with each other and fixes the toner image on the recording medium P while conveying the recording medium P by the transfer nip T3. The transfer nip T3 is formed by bringing the fixing roller 132 into pressure contact with the fixing roller 131 heated by a lamp heater or the like (not shown) from inside thereof. The toner image is fixed to the recording medium P as the recording medium P is heated and pressed while being nipped and conveyed by the transfer nip T3. The recording medium P on which the toner image has been fixed by the fixing apparatus 130 is then discharged out of the apparatus body.

It is noted that while the image forming apparatus 1 configured to secondarily and collectively transfer the composite toner images of the respective colors after primarily transferring the toner images of the respective colors from the photosensitive drums 101 of the respective colors to the intermediate transfer belt 121 has been described here, the present invention is not limited to such configuration. For instance, the image forming apparatus may be a direct transfer type image forming apparatus configured to directly transfer from the photosensitive drum 101 to the recording medium P carried on and conveyed by a transfer member conveying belt for example. Still further, the system of the image forming apparatus is not limited to one described above concerning also the charging system, the transfer system, the cleaning system, and the fixing system.

Two-Component Developer

In the developing apparatus 104 shown in FIG. 1, two-component developer containing negative charged toner (non-magnetic) and positive charged carrier is used as the developer. The toner contains a binding such as styrene resin and polystyrene resin, a coloring agent such as carbon black, die, and pigment, and coloring particles into which coloring resin particles including other additives as necessary and external additives such as colloidal silica fine powder. A volume average particle size of the toner is preferable to be 4 μm to 10 μm because if the particle size is too small, it becomes hard for the toner to cause friction with the carrier, and it becomes hard to control a toner electrification amount, and if the particle size is too large, it becomes unable to form a precision toner image. For example, toner of negative charged polyester resin whose volume average particle size is 7.0 μm is used.

Meanwhile, in terms of the carrier, metals such as surface-oxidized or non-oxidized iron, nickel, cobalt, manganese, chrome and rare earth, their alloy, or ferrite oxide can be suitably used. Volume average particle size of the carrier may cause such problems that the carrier adheres the photosensitive drum 101 during development if the particle size is too small, and that the carrier disturbs a toner image during the development if the particle size is too large in contrary. Then, ferrite carrier whose volume average particle size is 40 μm is used for example. It is noted that two-component developer whose initial weight ratio of toner and carrier is 1:9 is used in the present embodiment.

Developing Apparatus

Next, a configuration of the developing apparatus 104 will be described with reference to FIGS. 2 and 3. The developing apparatus 104 shown in FIG. 2 is a vertical agitating type developing apparatus in which a supply chamber 401 and a recovery chamber 403 are vertically disposed. The developing apparatus 104 includes a developing container 2, i.e., a housing, a developing sleeve 6, i.e., a developer carrier, and a regulating blade 5, i.e., a regulating member. The developing sleeve 6 is partially exposed out of an opening 2*a* of the developing container 2 provided at a position facing the photosensitive drum 101 and is disposed rotably in the developing container 2. The developing sleeve 6 rotates in a direction of an arrow R3 in FIG. 2 while carrying the developer D whose layer thickness is regulated by the regulating blade 5 to convey the developer D to the photosensitive drum 101 facing thereto. The developer D carried on the developing sleeve 6 is slid on the photosensitive drum 101. Thereby, the toner is supplied to an electrostatic image which has been formed on the photosensitive drum 101 and the electrostatic image is developed as a toner image. The developing sleeve 6 has a diameter of 20 mm for example, and the photosensitive drum 101 has a diameter of 80 mm for example.

Here, changes of conveyance of the developer D caused by differences of surface nature of the developing sleeve 6 will be described. If the surface of the developing sleeve 6 is smooth like a mirror surface for example, a friction force generated between the developer D and the surface of the developing sleeve is extremely small. Due to that, if the surface of the developing sleeve 6 is smooth, the developer D is barely conveyed even if the developing sleeve 6 rotates.

Meanwhile, if the surface of the developing sleeve 6 is irregular, a friction force generated between the developer D and the surface of the developing sleeve 6 is large as compared to the case when the surface of the developing sleeve 6 is smooth. Accordingly, the developer D is liable to be readily conveyed following the rotation of the developing sleeve 6 when the surface of the developing sleeve 6 is irregular. In view of this fact, the surface of the developing sleeve 6 is formed to have irregularity, i.e., surface roughness of around 15 μm. A blast processing is implemented to make the irregular surface of the developing sleeve 6. The blast processing is a process of making the irregularity by blasting such particles as polishing powder and glass beads having a predetermined particle size distribution in high pressure. In view of that the developer D is conveyed by the blast-processed irregular area, the irregular area is formed in a range slightly wider than a maximum area in which an image can be formed on the photosensitive drum 101.

Magnet Roller

The developing sleeve 6 is formed into a cylindrical shape by a non-magnetic material such as aluminum and stainless steel and is provided with a magnet roller 6*m*, i.e., a magnetic field generating portion, fixed therein. The magnet roller 6*m* includes a developing pole S1 and magnetic poles S2, N1, N2, and N3 carrying and conveying the developer D. Here, as shown in FIG. 2, the developing pole Si is disposed to face the photosensitive drum 101 at a developing area A, and the magnetic pole S2 is disposed to face the regulating blade 5. Still further, the magnetic pole N1 is disposed between the magnetic poles S1 and S2, the magnetic pole N2 is disposed upstream in a developing sleeve rotation direction of the magnetic pole S2, and the magnetic pole N3 is disposed downstream in the developing sleeve rotation direction of the developing pole S1. Magnetic bristles (or magnetic brushes) of the developer D are formed by magnetic force of these magnetic poles on the surface of the developing sleeve 6. However, a repulsive magnetic field is formed between the magnetic poles N2 and N3, i.e., at a position where the same poles are adjacent with each other. The developer D is separated from the surface of the developing sleeve 6 by this repulsive magnetic field and is recovered to the recovery chamber 403.

Regulating Blade

As described above, the magnetic bristles of the developer D are formed on the surface of the developing sleeve 6. A layer thickness of the magnetic bristles is regulated by the regulating blade 5, and then the magnetic bristles are sent to the developing area A. The regulating blade 5 is a plate-like member formed of a non-magnetic material such as aluminum and is disposed along a longitudinal direction of the developing sleeve 6 upstream in the developing sleeve rotation direction of the photosensitive drum 101. Still further, the regulating blade 5 is disposed to face the developing sleeve 6 such that an edge thereof is directed to a turning center of the developing sleeve 6. A bristle cutting amount of the magnetic bristles formed on the surface of the developing sleeve 6 is regulated and an amount of the developer conveyed to the developing area A is adjusted by adjusting a gap between the edge of the regulating blade 5 and the surface of the developing sleeve 6.

It is noted that it is not preferable if the gap between the regulating blade 5 and the developing sleeve 6 is too narrow because foreign matters and aggregates of the toner tend to be clogged. Still further, if the amount of the developer D conveyed by the developing sleeve 6 becomes excessive, such problems that the developer D is clogged in the vicinity of a position where the photosensitive drum 101 and the developing sleeve 6 are closest (specifically at the developing area A) or the carrier adheres to the photosensitive drum 101 may occur. Meanwhile, if the amount of the developer D conveyed by the developing sleeve 6 is too small, such a problem that a desirable toner image cannot be developed may occur. In order to prevent such problems, the gap at the closest position of the regulating blade 5 and the developing sleeve 6 is set at 400 μm for example to adjust the amount of the developer D conveyed by the developing sleeve 6 to around 30 mg/cm$^2$ for example in the present embodiment.

The developing sleeve 6 rotates in a same direction (in the direction of the arrow R3) with the photosensitive drum 101 while carrying the developer whose layer thickness has been regulated by the regulating blade 5 that cuts the magnetic bristles to convey the developer to the developing area A. For instance, a circumferential speed of the photosensitive drum 101 is 300 mm/s and a circumferential speed of the developing sleeve is 450 mm/s. A ratio of the circumferential speed of the developing sleeve 6 to that of the photosensitive drum 101 is normally set between 1.0 to 2.0 times. While the larger the circumferential speed ratio, the higher the development efficiency is, such problems that scattering of toner and deterioration of the developer are apt to be generated if the circumferential speed ratio is too large, so that preferably the circumferential speed ratio is set within the range of 1.0 to 2.0.

In the developing area A, the edges of the magnetic bristles formed at the developing pole S1 slide against the photosensitive drum 101. Thus, the toner is supplied to the electrostatic latent image formed on the photosensitive drum 101 and the electrostatic latent image is developed as a toner image. At this time, in order to improve the development efficiency, i.e., an application rate of the toner to the electrostatic latent image, developing bias voltage in which AC voltage is superimposed on DC voltage is applied to the developing sleeve 6 from a power source not shown. For instance, oscillation voltage in which AC voltage whose peak-to-peak voltage is 1800 V, frequency is 12 kHz, and wave form is rectangular is superimposed on DC voltage of −500 V is applied. As a matter of course, the values of the DC and AC voltages and waveform are not limited to them.

Developing Container

The two-component developer D containing the non-magnetic toner and the magnetic carrier is stored by 300 g for example in the developing container 2. An inside of the developing container 2 storing the developer D is partitioned into an upper supply chamber 401 and a lower recovery chamber 403 by a partition wall 300 extending in a direction vertical to a sheet surface of FIG. 2. The supply chamber 401 communicates with the recovery chamber 403 vertically through opening portions 404*a* and 404*b* provided at both end parts of the developing container 2 (the supply chamber 401 and the recovery chamber 403) as shown in FIG. 3, thus forming a circulating route of the developer. The developing apparatus 104 of the present embodiment has the so-called function separated configuration having the supply chamber 401 supplying the developer to the developing sleeve 6 and the recovery chamber 403 recovering the developer from the developing sleeve 6.

A developing screw 31, i.e., a first conveying portion, and an agitating screw 32, i.e., a second conveying portion, are rotably provided respectively in the supply chamber 401, i.e., a first chamber, and the recovery chamber 403, i.e., a second chamber. Then, conveying screws (conveying portions) conveying the developer within the developing apparatus are composed of the developing and agitating screws 31 and 32 in the present embodiment. As shown in FIG. 3, a developing screw gear 503, an agitating screw gear 504, and a developing sleeve gear not shown are provided at one end (left-hand side in FIG. 3) of the developing screw 31, the agitating screw 32 and the developing sleeve 6. The developing sleeve gear receives driving force from a developing sleeve driving portion 501 (see FIG. 2) and rotates the developing sleeve 6. The developing screw gear 503 receives driving force from a developing screw driving portion 502 (see FIG. 2) and rotates the developing screw 31. In the same time, the driving force from the developing screw driving portion 502 is transmitted also to the agitating screw gear 504 to rotate the agitating screw 32 in the same time with the developing screw 31.

The developing and agitating screws 31 and 32 have a screw structure in which agitating blades formed of a nonmagnetic material are provided spirally around rotating shafts. Accordingly, as the developing and agitating screws 31 and 32 rotate, the developer is circularly conveyed within the developing container 2 while being agitated. Along with the agitation of the developer, the toner is electrified to negative and the carrier to positive. The developing screw 31 is disposed substantially in parallel with the rotating shaft of the developing sleeve 6 within the supply chamber 401, and the agitating screw 32 is disposed substantially in parallel with the developing screw 31 within the recovery chamber 403. When the developing screw 31 rotates, the developer within the supply chamber 401 is conveyed unidirectionally from the left-hand side to the right-hand side in FIG. 3 along the rotating shaft of the developing screw 31. The developer conveyed downstream in a developer conveying direction of the supply chamber 401 drops from the opening portion 404*a* to the recovery chamber 403 by its own weight. Meanwhile, as the agitating screw 32 rotates, the developer within the recovery chamber 403 is conveyed along the rotating shaft of the agitating screw 32 unidirectionally from the right-hand side to the left-hand side in FIG. 3, i.e., in a direction opposite from that of the developer within the supply chamber 401. The developer conveyed downstream in the developer conveying direction is scooped up by the agitating screw 32 from the opening portion 404*b* to the supply chamber 401. The developer conveyed thus by the rotation of the developing and agitating screws 31 and 32 is circularly conveyed between the supply and recovery chambers 401 and 403 in a direction indicated by an arrow R4 through the opening portions 404*a* and 404*b* provided at the both end parts of the partition wall 300.

In the developing apparatus 104, the developer is conveyed along a first conveying path (circulating route) through which the developer circulates the supply and recovery chambers 401 and 403 through the opening portions 404*a* and 404*b* as described above. The developer is also conveyed along a second circulating route in the developing apparatus 104. That is, in the developing apparatus 104, the developer is supplied from the supply chamber 401 to the developing sleeve 6, and the developer supplied to the developing sleeve 6 is involved in the development. In other words, the first circulating route is a circulating route not contributing to the development and the second conveying path contributes to the development. The developer which has involved in the development on the developing sleeve 6 and whose toner concentration has dropped is recovered exclusively to the recovery chamber 403. The recovered is fully blended with replenishing developer within the recovery chamber 403 to restore the toner concentration and is then returned to the supply chamber 401 so that it is carried again by the developing sleeve 6 to be used for the development. Thereby, the toner concentration of the developer carried on the developing sleeve 6 is kept constant. The toner concentration of the developer is detected by a toner concentration sensor not shown and provided at at least one of the opening portion 404*a* and 404*b* communicating the supply chamber 401 with the recovery chamber 403. The toner concentration sensor detects permeability of the developer. The recovery chamber 403 is also provided with a developer temperature detecting sensor 601, i.e., a developer temperature detecting portion, for detecting temperature of the developer.

Measure Against Changes of Toner Characteristics

By the way, along with the image forming operation, the toner within the developing container 2 receives load and changes its shape and surface nature, i.e., its characteristics. While the change of the toner characteristics is swayed by a time during which the toner receives the load within the developing container 2, the change of the toner characteristics is remarkable in a case where images that consume less toner are continuously formed in particular. In the case of the image forming apparatus 1 including the plurality of developing apparatuses 104 as shown in FIG. 1, there can be the developing apparatus 104 that consumes no toner during the image forming operation. Normally, such developing apparatus 104 performs a process for maintaining the toner characteristics. Specifically, a toner minimum consumption amount is determined in advance per number of recording media on which images are formed or per number of rotations of the developing sleeve 6, and if a toner consumption amount is lower than that, the developing apparatus 104 executes a control of replacing a part of the contained toner with new toner by replenishing the new toner after consuming the old toner by performing development on an area out of an image forming area or between image forming operations.

For instance, the toner minimum consumption is set at 1% of a toner maximum consumption amount consumed when a full-surface maximum concentration image is outputted on a basis of A4 size. Specifically, if toner consumption amount in the maximum concentration is 0.5 mg/cm$^2$, the toner maximum consumption amount in forming an image on a recording medium of A4 size is 0.31 g. In such a case, if an average toner consumption amount per number (predetermined number) of recording media on which images have been formed is lower than 1% of the toner maximum consumption amount, a control of consuming the toner is executed so that the average toner consumption amount becomes 1% Accordingly, the change of the toner characteristics is seen most in forming images consecutively such that the toner consumption is 1%. However, it is necessary to feed about 10,000 sheets until when an average time when the toner within the developing container 2 receives load reaches a predetermined value. This can be calculated from a toner consumption amount and a toner amount within the developer.

Replenishment of Developer

In the developing apparatus 104, replenishing developer (referred to as 'replenishing agent' hereinafter) is replenished from a developer replenishing unit 12, i.e., a replenishing portion. A replenishing port 11 is provided above the upstream side in the developer conveying direction of the recovery chamber 403, and the developer replenishing unit 12 is connected to the replenishing port 11 through a replenishing path not shown. The replenishing agent is supplied from the developer replenishing unit 12 to the recovery chamber 403 through the replenishing port 11, and the replenishing agent supplied to the recovery chamber 403 is conveyed downstream in the conveying direction by the agitating screw 32. The developer replenishing unit 12 adjusts a replenishing amount of the replenishing agent so that the toner concentration becomes around 10% in weight ratio based on a ratio of toner and carrier calculated in accordance to a detected value of a toner concentration sensor not shown. Thereby, toner of an almost same amount of toner which has been consumed during the image forming operation is replenished.

Replenishing Agent

The replenishing agent also contains both toner and carrier. For instance, a replenishing agent in which toner and carrier are blended with 9:1 in weight ratio may be used. The replenishing agent containing not only the toner but also the carrier is used to prevent charging performance of the carrier from dropping along the image forming operation. That is, the charging performance of the carrier is maintained by replenishing new carrier and the charge amount of the toner is thus kept within an adequate range. Note that it is also possible to arrange such that the developer replenishing unit 12 replenishes a replenishing agent composed of only toner and a replenishing agent composed of only carrier separately.

Discharge Port

A discharge port 13, i.e., a discharge portion, is provided at a predetermined level of a side wall at downstream in the developer conveying direction of the supply chamber 401 to replace the developer by means of a trickle system. According to the trickle system, the developer that has become surplus due to the replenishment of the replenishing agent overflows out of the discharge port 13 and is discharged. That is, if the developer faces level becomes higher than the discharge port 13, the developer that has increased more than the discharge port 13 overflows out of the discharge port 13 and is discharged out of the developing container 2. That is, because the carrier deteriorates and the charging performance drops due to the use, the so-called carrier refreshing arrangement of replenishing new developer and discharging extra developer out of the discharge port is adopted also in the present embodiment. Normally, the height of the discharge port 13 is determined in accordance to a developer face level when the developer face level in forming images is stabilized (stationary state). FIG. 4 shows a distribution of the developer when the face level of the developer in forming images is stabilized (stationary state). As indicated by a dot chain line in FIG. 4, the face level is gradually lowered in a direction upstream to downstream in the developer conveying direction in the supply chamber 401, and the face level of the developer is almost equalized with the level of the discharge port 13 near the discharge port 13. Meanwhile, the face level gradually increases from downstream to upstream in the developer conveying direction in the recovery chamber 403. Here, such distribution of the developer close to the stationary state will be referred to as an adequate distribution of developer in forming images.

Control Portion

As shown in FIG. 2, the developing apparatus 104 further includes a control portion 500, a developing sleeve driving portion 501, and a developing screw driving portion 502. The control portion 500 controls drives of the developing sleeve 6 driven by the developing sleeve driving portion 501 and drives of the developing and agitating screws 31 and 32 driven by the developing screw driving portion 502. The developing sleeve driving portion 501 and the developing screw driving portion 502 are driving sources such as a motor. The developing sleeve 6 rotates as a driving force of the developing sleeve driving portion 501 is transmitted to the developing sleeve gear not shown. The developing and agitating screws 31 and 32 rotate as a driving force of the developing screw driving portion 502 is transmitted to the developing screw gear 503 and the agitating screw gear 504 (see FIG. 3). The control portion 500 can change driving speed, e.g., rotational speed, of the developing sleeve 6 the developing and agitating screws 31 and 32 by controlling the developing sleeve driving portion 501 and the developing screw driving portion 502.

The control portion 500 executes an image forming job (print job). The image forming job will be described with reference to FIGS. 5 and 6. FIG. 5 is a flowchart of the image forming job of the present embodiment, and FIGS. 6A and 6B are timing charts showing each control of the image forming job of the present embodiment.

The control portion 500 starts an image forming control of forming images on a predetermined number of recording media and outputting prints in Step S1. Corresponding to the start of the image forming control, the control portion 500 controls to drive the developing and agitating screws 31 and 32 at 800 rpm of screw rotational speed Vsc and the developing sleeve 6 at 600 rpm of screw rotational speed Vsl.

The control portion 500 counts a total number of sheets (recording media) already printed out during a period from the start of the image forming control and the present moment and counts a number of sheets (recording media) printed out (referred to as an 'cumulative number of sheets' hereinafter) since a previous execution of a developer overflow restraining control of controlling an overflow of the developer as specified later in Step S2, i.e., of a mode in which a developer conveyance failure preventing control as specified later in Step S7 is executed. As shown in FIGS. 6A and 6B, the screw rotational speed Vsc is kept at 800 rpm and the sleeve rotational speed Vsl at 600 rpm while printing out continuously (in forming an image).

The control portion 500 judges whether or not the total number of sheets already printed out has reached a predetermined number of printed sheets in Step S3. When the control portion 500 judges that the total number of sheets already printed out has reached the predetermined number of printed sheets, i.e., Yes in Step S3, the control portion 500 finishes the image forming control in Step S4. That is, the control portion 500 controls to stop the developing and agitating screws 31 and 32 and the developing sleeve 6 by setting the screw rotational speed and the sleeve rotational speed at 0 rpm.

When the control portion 500 judges that the total number of sheets already printed out has not reached the predetermined number of sheets, i.e., No in Step S3, the control portion 500 continues to form images and updates the total number of sheets and the cumulative number of sheets. Then, the control portion 500 judges whether or not the developer overflow restraining control should be executed in Step S5. The control portion 500 can judge whether or not the developer overflow restraining control should be executed by judging whether the cumulative number of sheets (denoted as N in FIG. 5) for example has reached the predetermined number of sheets (5,000 sheets for example), i.e., whether or not the cumulative number of sheets is greater than a threshold value. It is also possible to arrange such that the control portion 500 determines whether or not the developer overflow restraining control should be executed by judging whether or not an image forming time has reached a predetermined time (whether or not greater than a threshold value), or by judging whether or not a number of rotations of the developing sleeve 6 has reached a predetermined number of rotations. When the cumulative number of sheets has reached the predetermined number of sheets (or, the image forming time has reached the predetermined time or the number of rotations of the developing sleeve 6 has reached the predetermined number of rotations), the control portion 500 judges that the developer overflow restraining control should be executed.

When it is judged that the developer overflow restraining control should not be executed, i.e., No in Step S5, the control portion 500 returns to and continues the process of Step S2. In this case, the screw rotational speed is kept at 800 rpm and the sleeve rotational speed at 600 rpm, and the image forming control is continuously performed.

Meanwhile, when it is judged that the developer overflow restraining control should be executed, i.e., Yes in Step S5, the control portion 500 temporarily suspends the image forming control and executes the developer overflow restraining control in Step S6. That is, as shown in FIGS. 6A and 6B, the control portion 500 sets the screw rotational speed Vsc and the sleeve rotational speed Vsl at 0 rpm, i.e., the control portion 500 stops to drive the developing and agitating screws 31 and 32, and the developing sleeve 6. Then, while stopping the developing sleeve 6, the control portion 500 drives the developing and agitating screws 31 and 32 for two seconds at 800 rpm, i.e., at the same screw rotational speed with that during the image forming control. That is, in the developer overflow restraining control, the control portion 500 controls the developing and agitating screw 31 and 32 and the developing sleeve 6 in forming no image such that a ratio of rotational speeds (Vsc/Vsl) increases as compared to that in forming an image. It is noted that the cumulative number of sheets is cleared in the case when the developer overflow restraining control has been executed.

After the developer overflow restraining control, the control portion 500 executes the developer conveyance failure preventing control specified later in Step S7. As shown in FIGS. 6A and 6B, in the developer conveyance failure preventing control (referred to simply as 'conveyance failure preventing control' hereinafter), the control portion 500 sets the screw rotational speed at 0 rpm to stop driving the developing and agitating screws 31 and 32. Then, while stopping the developing and agitating screws 31 and 32, the control portion 500 drives only the developing sleeve 6 for one second at 600 rpm, i.e., at the same sleeve rotational speed with that in forming an image. That is, the control portion 500 controls the developing and agitating screws 31 and 32 and the developing sleeve 6 in forming no image such that the ratio of rotational speeds (Vsc/Vsl) decreases as compared to that in forming an image in the conveyance failure preventing control.

When images are continuously formed, the developer that remained without being able to pass through the gap between the regulating blade 5 and the developing sleeve 6 stagnates behind the regulating blade 5 (at upstream in the rotational speed of the developing sleeve 6, see FIG. 2) and forms an immobile layer in the developing apparatus 104. Then, if the developer is scrubbed at a boundary between the immobile layer and a fluid layer, the toner is released from the developer and deposits, thus forming a toner layer. Because this toner layer narrows the gap between the developing sleeve 6 and the regulating blade 5, it hampers the supply of the developer to the developing sleeve 6 and causes a conveyance failure. Then, the control portion 500 executes the conveyance failure preventing control described above to remove the toner layer and to prevent the developer conveyance failure caused by the toner layer. However, in the function separated type developing apparatus, there is a case when the conveyance failure preventing control is executed that the developer conveyed by the developing sleeve 6 from the supply chamber 401 to the recovery chamber 403 overflows to the outside without being recovered into the recovery chamber 403. It is because the ratio of rotational speeds (Vsc/Vsl) in forming no image is decreased as compared to that in forming an image in the conveyance failure preventing control, the developer recovered from the developing sleeve 6 stagnates in the recovery chamber 403 and a space capable of storing the developer becomes insufficient in the recovery chamber 403.

Then, an enough space capable of storing the developer is assured in advance in the recovery chamber 403 by executing the mode of performing the developer overflow restraining control before the conveyance failure preventing control described above in the present embodiment. When the developing and agitating screws 31 and 32 are driven, the developer is circularly conveyed within the supply and recovery chambers 401 and 403. If the developing sleeve 6 is controlled, e.g., stopped in particular, together with the drive of the developing and agitating screws 31 and 32 such that the ratio of rotational speeds (Vsc/Vsl) increases as compared to that in forming an image, while the developer continues to increase within the supply chamber 401, the developer within the recovery chamber 403 decreases. That is, while a relative developer amount circularly conveyed by the developing and agitating screws 31 and 32 within the supply and recovery chambers 401 and 403 is not changed, a developer amount conveyed by the developing sleeve 6 from the supply chamber 401 to the recovery chamber 403 decreases. Due to that, the developer increases within the supply chamber 401 and the developer within the recovery chamber 403 decreases. If the developer within the recovery chamber 403 decreases, the space capable of storing the developer expands by that much.

Returning to the flowchart in FIG. 5, after performing the conveyance failure preventing control in Step S7, the control portion 500 returns to and continues the process in Step S2. As shown in FIGS. 6A and 6B, the control portion 500 once suspends to drive the developing and agitating screws 31 and 32 and the developing sleeve 6. Then, the control portion 500 drives the developing and agitating screws 31 and 32 and the developing sleeve 6 such that the screw rotational speed is set at 800 rpm and the sleeve rotational speed at 600 rpm in resuming the image forming control once suspended.

Table 1 shows experimental results obtained by measuring the developer amount overflown without being stored in the recovery chamber 403 in starting to form images in a case (Yes) of executing the developer overflow restraining control before the conveyance failure preventing control and in a case (No) of executing no developer overflow restraining control before the conveyance failure preventing control. As it is apparent from Table 1, no overflow of the developer occurs in the case when the developer overflow restraining control is executed before the conveyance failure preventing control.

TABLE 1

| | DEVELOPER OVERFLOW RESTRAINING CONTROL | |
|---|---|---|
| | EXECUTED | NOT EXECUTED |
| Vsc | 800 rpm | |
| DRIVING TIME | 2 s | |
| OVERFLOW | ○ (NONE) | X (EXIST) |

As described above, the developer overflow restraining control is executed before the conveyance failure preventing control in the present embodiment. Specifically, after performing the control of increasing the ratio of rotational speeds (Vsc/Vsl) in forming no image as compared to that in forming an image (developer overflow restraining control), the control of decreasing the ratio of rotational speeds (Vsc/Vsl) in forming no image as compared to that in forming an image (conveyance failure preventing control) is performed. While the developer within the supply chamber 401 increases, the developer within the recovery chamber 403 decreases by executing the developer overflow restraining control. That is, the space for recovering the developer conveyed by the developing sleeve 6 can be assured in advance within the recovery chamber 403. Thereby, the developer does not overflow to the outside without being stored in the recovery chamber 403 in removing the toner layer by the conveyance failure preventing control.

<Second Embodiment>

A second embodiment of the present invention will be described with reference to FIGS. 2 and 3 and by using FIGS. 6A and 6B. The first embodiment described above does not specifically consider the discharge of the developer out of the discharge port 13 in executing the developer overflow restraining control before the conveyance failure preventing control. In contrary, the present embodiment performs a control considered such that the developer is not excessively discharged out of the discharge port 13 in executing the developer overflow restraining control.

As described above, the developing apparatus 104 is the function separated type developing apparatus having the carrier refreshing configuration to be able to discharge old carrier and all developer whose charging performance has dropped out of the discharge port 13. Then, the developing apparatus 104 is configured to be able to keep not only the charging performance of the carrier within the developing container 2 but also the toner charging amount by filling new carrier along with the replenishment of the replenishing agent from the developer replenishing unit 12. However, this configuration has a possibility that the developing function cannot be performed as a result because the developer within the developing container 2 gradually decreases if an amount of discharged carrier is greater than an amount of filled carrier and if such situation continues. That is, if the developer is excessively discharged and the developer within the developing container 2 becomes insufficient, it becomes unable to adequately supply the developer to part of the developing sleeve 6, possibly causing such an inferior image that part of the toner image is missed. This problem may occur in performing the developer overflow restraining control in which the developer is forcibly conveyed to the supply chamber 401. Due to that, it is necessary to consider so that the developer is not discharged excessively out of the discharge port 13 in performing the developer overflow restraining control.

Because the respective controls of the present embodiment other than the developer overflow restraining control are the same with the first embodiment as shown in FIGS. 7A and 7B, a detailed explanation thereof will be omitted here. In the present embodiment, the control portion 500 drives the developing and agitating screws 31 and 32 at 400 rpm of screw rotational speed for four seconds while stopping the developing sleeve 6 in executing the developer overflow restraining control of increasing the ratio of rotational speeds (Vsc/Vsl) in forming no image as compared to that in forming an image. That is, as compared to the case of not considering the excessive discharge of the developer, the screw rotational speed is changed from 800 to 400 rpm and the driving time is changed from two seconds to four seconds.

Table 2 shows experimental results obtained by measuring the discharged developer amounts and whether or not an overflow has occurred when the developer overflow restraining control is executed by changing the screw rotational speed and the driving time. As it is apparent from Table 2, no overflow occurs when the screws are driven at 800 rpm of rotational speed for two seconds by considering only the overflow of the developer. However, a discharged developer amount (discharge amount) is 6 g. In contrary to that, not only that no overflow occurs but also the discharged developer amount (discharge amount) is lessened to 2 g in a case when the screws are driven at 400 rpm of rotational speed for four seconds by considering not only the overflow of the developer but also the excessive discharge of the developer. That is, it is possible to reduce the developer discharged in executing the developer overflow restraining control by lowering the screw rotational speed further. However, although the discharge amount is lessened, the overflow occurs as shown in Table 2 without changing the driving time in lowering the screw rotational speed (two seconds at 400 rpm). It is because while the developer amount conveyed from the supply chamber 401 to the recovery chamber 403 is lessened when the screw rotational speed is lowered, the developer within the recovery chamber 403 is not reduced and an enough space for storing the developer cannot be assured.

TABLE 2

| Vsc | 400 rpm | 400 rpm | 800 rpm | 800 rpm |
|---|---|---|---|---|
| DRIVING TIME | 4 s | 2 s | 2 s | 1 s |
| DISCHARGE AMOUNT | 2 g | 1 g | 6 g | 3 g |
| OVERFLOW | ○ (NONE) | X (EXIST) | ○ (NONE) | X (EXIST) |

As described above, the developer overflow restraining control is executed while lowering the screw rotational speed as compared to that in forming an image and by prolonging the driving time accordingly in the present embodiment. This arrangement makes it possible to prevent the overflow of the developer and also to restrain the excessive discharge of the developer. It is noted that although it is desirable not to cause the overflow of the developer, it is possible to reduce a developer leakage amount in executing the developer conveyance failure preventing control by executing the developer overflow restraining control even when the leakage of the developer occurs.

<Third Embodiment>

By the way, because only the developing sleeve 6 is driven in the conveyance failure preventing control, the developer is conveyed only from the supply chamber 401 to the recovery chamber 403. As a result, the distribution of the developer is changed such that the developer is stored more in the recovery chamber 403 than the supply chamber 401 as shown in FIG. 10, differing from the time when an image is formed. Still further, as compared to the stationary state in which the developer face level is stabilized in forming an image (see FIG. 4), spots where the developer amount is biased and the developer face is raised are partly generated in the supply and recovery chambers 401 and 403. That is, the developer amount at a spot facing the developing sleeve 6 is less in the supply chamber 401 and in contrary to that, the developer amount at a spot facing the developing sleeve 6 is large in the recovery chamber 403. It is because the developer is conveyed only by the developing sleeve 6 and only the developer amounts at the spots facing the developing sleeve 6 fluctuate.

In a case when the image forming operation is performed right after when the conveyance failure preventing control has been performed (see Steps S6 and S7 in FIG. 5), such a problem that the developer is excessively discharged and the developer within the developing container 2 becomes insufficient could happen. It is because the distribution of the developer is different from the normal distribution in forming an image in driving the developing and agitating screws 31 and 32 at 800 rpm of screw rotational speed and the developing sleeve 6 at 600 rpm of sleeve rotational speed. In such a case, the developer at the spot where there is much developer as compared to the stationary state (in forming an image) shown in FIG. 4 is conveyed to and is discharged out of the discharge port 13. In order to prevent such condition, it is just necessary to perform a control of driving the developing and agitating screws 31 and 32, and the developing sleeve 6 at speeds lower than those in forming an image by a predetermined time period, e.g., a time during which the developer circulates at least about a half of the circulating route within the developing container 2. A third embodiment of the present invention will now be described below with reference to FIGS. 8 and 9.

FIG. 8 is a flowchart of an image forming job of the present embodiment. However, because processes of Steps S1 through S7 are the same with those processes shown in FIG. 5 described above, their explanation will be omitted here. As shown in FIG. 8, the control portion 500 executes a developer face leveling control after executing the conveyance failure preventing control as follows in Step S8. In the developer face leveling control, the control portion 500 drives the developing and agitating screws 31 and 32 at 400 rpm of screw rotational speed and the developing sleeve 6 at 200 rpm of sleeve rotational speed simultaneously for 10 seconds as shown in FIGS. 9A and 9B. The screw rotational speed of 400 rpm and sleeve rotational speed of 200 rpm are slower than 800 rpm of screw rotational speed and 600 rpm of sleeve rotational speed in forming an image. It is noted that the driving time of ten seconds here corresponds to a time during which the developer is circularly conveyed by about one round within the developing container 2. However, because this driving time may be a time during which the developer is conveyed at least by about a half round of the circulating route within the developing container 2, the driving time may be not ten seconds but may be five seconds or more.

If the screw rotational speed is lowered, a moving amount, i.e., moving speed, of the developer per unit time within the developing container 2 becomes small as compared to that in forming an image. If the moving amount of the developer is small, it takes time for the developer at the spot where there is much developer conveyed to the discharge port 13 as compared to the developer in the stationary state shown in FIG. 4. The developer is conveyed at the slow moving speed and collapses during that time, so that the spot where there is much developer as compared to the stationary state is eliminated and the developer face is leveled. Still further, because the developer face shakes less when the developer is driven at low speed, the discharge amount is restrained even if the developer face near the discharge port 13 is the same. It is noted that the driving time during which the developer circulates by a half of the circulating route within the developing container 2 is obtained by dividing a longitudinal length of the developing container 2 (more specifically, the supply chamber 401) by the moving speed of the developer per unit time within the developing container 2. That is, the driving time varies depending on the screw rotational speed and the longitudinal length of the developing container 2. For instance, the driving time can be calculated by dividing a distance of one round or of a half round of the circulating route by average speed of the developer conveyed by the screw rotational speed. Still further, the distance of one round of the circulating route may be a distance in which twice of a gap between the rotating shafts of the developing and agitating screws 31 and 32 is added to a length in a direction of the rotating shafts of the developing and agitating screws 31 and 32 between both center parts of the opening portions 404*a* and 404*b* for example.

Then, by driving the developing sleeve 6 synchronized with the developing and agitating screws 31 and 32, the developer is prevented from being excessively discharged out of the discharge port 13 by creating a state in which the developer face level is gradually lowered in the same manner with the stationary state in forming an image as shown in FIG. 4. The moving amount of the developer is also adjusted at that time so that much developer is not stored in either one of the supply and recovery chambers 401 and 403 by driving the developing sleeve 6 at the slow sleeve rotational speed as compared to that in forming an image. For instance, much developer may be stored in the recovery chamber 403 if the sleeve rotational speed is set at 600rpm which is the same with that in forming an image, and much developer may be stored in the supply chamber 401 if the sleeve rotational speed is extremely slow, e.g., 50 rpm. These developers form developer distributions different from that in forming an image. That is, the sleeve rotational speed is determined by the screw rotational speed. In the developer face leveling control, the screw rotational speed is preferable to be 500 to 300 rpm, and the sleeve rotational speed is preferable to be 300 to 100 rpm. It is also needless to say that the screw rotational speed is a speed capable of generating power for scooping up the developer against the gravity at least from the recovery chamber 403 to the supply chamber 401, and the driving time varies depending on the screw rotational speed.

Returning to the flowchart in FIG. 8, the control portion 500 returns to and continues the process of Step S2 after the developer face leveling control in Step S8. As shown in FIGS. 9A and 9B, the control portion 500 suspends the drive of the developing and agitating screws 31 and 32 and of the developing sleeve 6 once after the developer face leveling control. Then, the control portion 500 drives the developing and agitating screws 31 and 32 and the developing sleeve 6 by setting the screw rotational speed at 800 rpm and the sleeve rotational speed at 600 rpm in resuming the image forming control temporarily suspended. It is noted that in performing the image forming control after the developer face leveling control in Step S8, the control portion 500 may change the rotational speeds from 400 to 800 rpm and from 200 to 600 rpm without once suspending the drives of the developing and agitating screws 31 and 32 and the developing sleeve 6.

Here, Table 3 shows experimental results obtained by measuring the developer amount discharged in starting the image forming operation in the cases when the developer face leveling control is executed and not executed. In a case when 300 g of developer is stored within the developing container 2, a developer amount (discharge amount) discharged out of the developing container 2 was '1.2 g' when the image forming operation was performed after executing the developer face leveling control. Meanwhile, the developer amount (discharge amount) discharged out of the developing container 2 was '2.0 g' in the case when the image forming operation was performed without executing the developer face leveling control. Thus, it is possible to reduce the developer discharged out in starting the image forming operation if the developer face leveling control is executed after the conveyance failure preventing control as compared to the case when the developer face leveling control is not executed.

TABLE 3

| | DEVELOPER FACE LEVELING CONTROL | |
|---|---|---|
| | EXECUTED | NOT EXECUTED |
| DISCHARGE AMOUNT | 1.2 g | 2.0 g |

As described above, the developing apparatus 104 has a mode of executing the developer face leveling control after the conveyance failure preventing control in which the ratio of rotational speeds (Vsc/Vsl) is decreased in the present embodiment. During the developer face leveling control, the developing and agitating screws 31 and 32 are driven at the low speed as compared to that in forming an image. Thereby, the developer moves within the developing container 2 at the slow moving speed as compared to that in forming an image. Still further, the developing sleeve 6 is driven at the low speed as compared to that in forming an image. Thereby, the moving amount and the distribution of the developer are adjusted, so that the developer is not unevenly stored in either one of the supply and recovery chambers 401 and 403. Even if the conveyance failure preventing control is executed along with the execution of such developer face leveling control, the developer is adjusted and is distributed within the developing container 2 in an appropriate condition for forming an image. Therefore, the developer will not be excessively discharged in starting the image forming operation. It is noted that as shown in FIGS. 11 and 12, the developer face leveling control described above may be executed when the conveyance failure preventing control is executed without performing the developer overflow restraining control.

<Fourth Embodiment>

Next, a fourth embodiment of the present invention will be described by using FIGS. 13 through 15 while making reference to FIGS. 2 and 3. The developer face leveling control is executed after executing the developer conveyance failure preventing control in the embodiments described above. In contrary to those embodiments, in the present embodiment, the developer face leveling control is executed after executing a developer discharge control of driving the conveying screws (developing and agitating screws) while setting the rotational speed of the developing sleeve to be slower than that in forming an image to restrain the developer from overflowing out of the developing apparatus even if the developer is unevenly stored in either one of the supply and recovery chambers. The other configurations and operations are the same with those of the third embodiment, so that an overlapped explanation and illustration with those of the third embodiment will be omitted or simplified. The same or corresponding components with those of the third embodiment will be denoted by the same reference numerals, and the following explanation will be made centering on parts different from the third embodiment.

In the present embodiment, the 'developer discharge control' is executed in order to prevent the developer conveyed by the developing sleeve 6 from overflowing to the outside without being stored in the recovery chamber 403. Here, FIG. 15 shows a distribution of the developer after the developer discharge control. Because the developer is forcibly conveyed from the recovery chamber 403 to the supply chamber 401 in the developer discharge control, while the developer becomes excessive in the supply chamber 401, it becomes insufficient in the recovery chamber 403 as a result. That is, as indicated by dot chain lines in FIG. 15, while much developer exists and the developer face level is high within the supply chamber 401 as compared to those of the stationary state, the developer amount is less and the developer face level is low within the recovery chamber 403 as compared to those of the stationary state.

Still further, if the developing sleeve 6 is stopped and only the developing and agitating screws 31 and 32 are driven in the case when the developer face level of the supply chamber 401 is lowered along downstream in the stationary state in forming an image like the present embodiment, no developer is conveyed by the developing sleeve 6. Therefore, the developer face level of the supply chamber 401 is not lowered even at a downstream location. The distribution of the developer differs depending on the shape of the screw and a conveying amount of the developing sleeve 6. However, in the function separated type developing apparatus of the present embodiment, the distribution of the developer in the longitudinal direction of the supply and recovery chambers 401 and 403 differs in a case when both the developing sleeve 6 and the developing and agitating screws 31 and 32 are driven from a case when only the developing and agitating screws 31 and 32 are driven.

If an image is started to be formed in the condition shown in FIG. 15, the developer at the spot where the developer face level is high is conveyed to the discharge port 13 without being collapsed, so that the developer is excessively discharged through the discharge port 13. Still further, if the developer at the spot where there exists less developer is conveyed from the recovery chamber 403 to the supply chamber 401, the developer supplied to the developing sleeve 6 becomes insufficient. In such a case, because the developing sleeve 6 cannot partly carry and convey an adequate amount of developer for the image forming operation, a missing part is generated partly in an image to be formed. Then, it is necessary to execute the control of leveling the developer face after the developer discharge control. The developer face leveling control to be executed after the developer discharge control will be described below by using FIGS. 13 and 14.

FIG. 13 shows a flowchart of an image forming job of the present embodiment. However, the processes of Steps S1 through S4 are the same with those processes of the third embodiment shown in FIG. 5 described above, so that their explanation will be omitted here.

The control portion 500 judges whether or not the developer discharge control should be executed in Step S12. The judgment of whether or not the developer discharge control should be executed may be determined whether or not a cumulative number of sheets has reached a predetermined number of sheets, e.g., 5,000 sheets, or whether or not an image forming time has reached a predetermined time. Still further, the judgment may be made by judging whether or not the number of rotations of the developing sleeve 6 has reached a predetermined number of rotations. When the cumulative number of sheets has reached the predetermined number of sheets (or the image forming time has reached the predetermined time, or the number of rotations of the developing sleeve 6 has reached the predetermined number of rotations), the control portion 500 executes the developer discharge control. While the developer discharge control will be described in detail later, it is a mode of controlling the developing and agitating screws 31 and 32 and the developing sleeve 6 while differentiating a relationship between the screw rotational speed and the sleeve rotational speed in forming no image from that in forming an image.

If the control portion 500 determines not to execute the developer discharge control, i.e., No in Step S12, the control portion 500 returns to and continues the process in Step S2. In this case, the screw rotational speed is kept at 800 rpm and the sleeve rotational speed at 600 rpm, and the image forming control is continuously performed.

Meanwhile, in a case when the control portion 500 determines that the developer discharge control should be executed, i.e., Yes in Step S12, the control portion 500 temporarily suspends the image forming control and executes the developer discharge control in Step S13. As shown in FIGS. 14A and 14B, the control portion 500 sets the screw rotational speed Vsc and the sleeve rotational speed Vsl at 0 rpm, i.e., stops driving the developing and agitating screws 31 and 32 and the developing sleeve 6. Then, while suspending the developing sleeve 6, the control portion 500 drives the developing and agitating screws 31 and 32 for three seconds at 600 rpm of rotational speed lower than that in forming an image. That is, in the developer discharge control, the control portion 500 controls the developing and agitating screws 31 and 32 and the developing sleeve 6 such that the ratio of rotational speeds (Vsc/Vsl) increases in forming no image as compared to that in forming an image. It is noted that in the case when the developer discharge control is executed, the cumulative number of sheets N is cleared.

After the developer discharge control, the control portion 500 executes the developer face leveling control in Step S14. In the developer face leveling control, the control portion 500 drives the developing and agitating screws 31 and 32 at 400 rpm of screw rotational speed and the developing sleeve 6 at 200 rpm of sleeve rotational speed simultaneously for ten seconds. The drive of ten seconds here corresponds to a time in which the developer is circularly conveyed by about one round within the developing container 2. The screw rotational speed of 400 rpm and the sleeve rotational speed of 200 rpm are low as compared to the screw rotational speed of 800 rpm and the sleeve rotational speed of 600 rpm in forming an image.

After executing the developer face leveling control, the control portion 500 returns to the process in Step S2. Then, as shown in FIGS. 14A and 14B, the control portion 500 once suspends driving the developing and agitating screws 31 and 32 and the developing sleeve 6. In resuming the image forming control once suspended, the control portion 500 drives the developing and agitating screws 31 and 32 and the developing sleeve 6 by setting the screw rotational speed at 800 rpm and the sleeve rotational speed at 600 rpm. It is noted that in the case when the control portion 500 performs the image forming operation after the developer face leveling control, the control portion 500 may perform a control of changing their rotational speeds from 400 to 800 rpm and from 200 to 600 rpm without once suspending driving the developing and agitating screws 31 and 32 and the developing sleeve 6.

Here, Table 4 shows experimental results obtained by measuring a developer amount discharged in starting to form an image in the case when the developer face leveling control is executed after the developer discharge control and the case when the developer face leveling control is not executed after the developer discharge control. When 300 g of developer is stored within the developing container 2, the developer amount discharged when the image forming operation was executed after executing the developer face leveling control was '1.1 g'. Meanwhile, the developer amount discharged in the case when the image forming operation was executed without executing the developer face leveling control was '1.8 g'. Thus, it is possible to reduce the developer amount discharged in starting the image forming operation by executing the developer face leveling control after executing the developer discharge control as compared to the case when the developer face leveling control is not executed.

TABLE 4

| | DEVELOPER FACE LEVELING CONTROL | |
|---|---|---|
| | EXECUTED | NOT EXECUTED |
| DISCHARGE AMOUNT | 1.1 g | 1.8 g |

As described above, the developer face leveling control is executed after the developer discharge control in the present embodiment. Thereby, the developing and agitating screws 31 and 32 and the developing sleeve 6 are driven at the low speeds as compared to those in forming an image, so that the developer distributes within the developing container 2 while being adjusted to the condition appropriate to the image forming operation. Therefore, the circulation of the developer is adequately carried out in starting the image forming operation, and the developer will not be excessively discharged. Still further, because it is possible to eliminate such condition that there is less developer amount and the developer face level is low as compared to the stationary state, no such problems that the supply of the developer to the developing sleeve 6 becomes insufficient and an image is partly missed occur.

<Fifth Embodiment>

Next, a fifth embodiment of the present invention will be described by using FIG. 16. In the first embodiment described above, the developing apparatus 104 includes no back-up member for backing up the developer conveyed by the conveying portion through the circulating route of the first chamber at upstream in the rotation direction of the developer carrier of the regulating member. Regarding this fact, the developing apparatus 104 includes a back-up member and performs a control of reducing a rate of the developer occupied in a buffer portion described later to be less than 50% in executing the conveyance failure preventing control. The other configuration and operations are the same with those of the first embodiment, so that an overlapped explanation and illustration with those of the first embodiment will be omitted or simplified here. The same or corresponding components with those of the first embodiment will be denoted by the same reference numerals, and the following explanation will be made centering on parts different from the first embodiment. FIG. 16 is a section view illustrating the configuration of the developing apparatus including the back-up member.

As shown in FIG. 16, the back-up member 600 is provided upstream in the rotation direction of the developing sleeve 6 of the regulating blade 5 and is constructed in a body with the partition wall 300 parting the supply and recovery chambers 401 and 403. The provision of the back-up member 600 makes it possible to form the buffer portion 602 between the supply chamber (first chamber) 401 and the regulating blade (regulating member) 5 and to store the developer conveyed from the developing screw 31 temporarily in the buffer portion 602 surrounded by the regulating blade 5 and the back-up member 600 upstream, in the rotation direction of the developing sleeve 6, of the regulating blade 5. It is possible to prevent periodic uneven distribution of the developer otherwise caused by the fact that the developer is directly supplied from the developing screw 31 to the developing sleeve 6 by supplying the developer to the developing sleeve 6 after temporarily storing in the buffer portion 602.

A toner layer is formed upstream of the regulating blade 5 along with the image forming operation also in the developing apparatus 104 including the back-up member 600. As described above, the toner layer possibly hampers the supply of the developer. There is also such a possibility that the toner layer collapses, and the collapsed toner layer is conveyed by the developing sleeve 6 and adheres on the photosensitive drum 101. Then, there is a case of causing a defective image called a toner stain or the like. Therefore, the toner layer must be removed.

The developer stored in the buffer portion 602 can be reduced by rotating only the developing sleeve 6. Then, in executing the conveyance failure preventing control (see Step S7 in FIGS. 5 and 8, and Step S10 in FIG. 11), the control portion 500 executes a control of suspending the developing and agitating screws 31 and 32 and of driving the developing sleeve 6 for two seconds at 600 rpm of sleeve rotational speed. The driving time of two seconds here is an enough time for the developing sleeve 6 to rotate by 20 times from the suspended state. If the developing sleeve 6 rotates by 20 times, it is possible to effectively restrain the immobile layer from being generated and to remove the toner layer. It is possible to remove the toner layer if a rate of the developer occupying the buffer portion 602 is lowered to 50% or less for example (as indicated by a dot chain line in FIG. 16) as described later. For instance, a developer amount corresponding to at least 50% of a volume of the buffer portion 602 is conveyed by the developing sleeve 6 from the supply chamber 401 to the recovery chamber 403. In this case, it is possible to prevent the overflow of the developer because the amount of the developer conveyed from the supply chamber 401 to the recovery chamber 403 by the developing sleeve 6 is limited. It is noted that in this case, it is not always necessary to stop the developing and agitating screws 31 and 32. That is, the developing and agitating screws 31 and 32 may be rotated if their rotational speed is a degree of rotational speed by which the developer is not supplied from the developing screw 31 to the buffer portion 602. The rate of the developer occupying the buffer portion 602 is counted by considering a space surrounded by a horizontal plane passing an apex of the back-up member 600, the back-up member 600, the developing sleeve 6, and the regulating blade 5 as 100%. In the conveyance failure preventing control of the present embodiment, the rotation time of the developing sleeve 6 is set at a time corresponding to a time during which the developer amount within the buffer portion 602 (the abovementioned space corresponding to 100%) is all conveyed. It is noted that the rotation time of the developing sleeve 6 may be set at a time during which the developer amount greater than the developer amount of 100% occupying the buffer portion 602 can be conveyed by considering a case where the developer is accumulated above the horizontal plane passing the apex of the back-up member 600. That is, the developer amount corresponding to the volume of the buffer portion 602 or more may be conveyed by the developing sleeve 6.

Here, Table 5 shows whether or not the toner stain has occurred in forming an image in a case when the rate of the developer occupying the buffer portion 602 is lowered to 50% or less and in a case when the ratio is not lowered to 50% or less by the conveyance failure preventing control. As it is apparent from Table 4, no toner stain occurred when the ratio was lowered to 50% or less. On the other hand, when the ratio was not lowered to 50% or less, a toner stain occurred.

TABLE 5

| | ELIMINATION TONER LAYER | |
|---|---|---|
| | ELIMINATED | NOT ELIMINATED |
| TONER STAIN | ○ (NONE) | X (EXIST) |

As described above, it is possible to convey the developer while collapsing the toner layer and to prevent the occurrence of the toner stain by conveying the developer stored in the buffer portion 602 from the supply chamber 401 to the recovery chamber 403 in the developing apparatus 104 including the back-up member 600. Specifically, the developer may be conveyed by the developing sleeve 6 from the supply chamber 401 to the recovery chamber 403 until when the toner layer can be removed (until when the rate of the developer occupying the buffer portion 602 becomes at least 50% or less in the present embodiment described above). That is, in this mode, the control portion 500 controls rotational speeds and rotation times of the conveying portion 31 and 32 and the developing sleeve 6 such that the ratio of the rotational speeds (Vsc/Vsl) decreases as compared to the ratio in forming an image until when a volume of the developer occupying in the buffer portion 602 becomes at least less than 50% of a volume of the buffer portion. Still further, because the developer amount conveyed from the supply chamber 401 to the recovery chamber 403 is limited, the recovery chamber 403 always has enough space as compared to a case when the developer amount is not limited. Accordingly, the developer conveyed by the developing sleeve 6 will not overflow to the outside without being recovered in the recovery chamber 403 when the conveyance failure preventing control is executed. The toner layer is eliminated if the rate of the developer occupying the buffer portion 602 is lowered at least to 50% or less, the toner stain caused by the toner layer is hardly generated.

<Other Embodiment>

While the developer overflow restraining control is executed before the conveyance failure preventing control, their executing timings are judged based on the cumulative number of sheets as described above (see Step S5 in FIGS. 5 and 8). It is because it is necessary to execute the conveyance failure preventing control before the toner layer narrows down the gap between the developing sleeve 6 and the regulating blade 5 and hampers the supply of the developer. By the way, the time until when the toner accumulates in the vicinity of the regulating blade 5 to a degree that hampers the supply of the developer, i.e., the time until when the toner layer that hampers the supply of the developer is formed, differs depending on temperature within the developing container 2 and toner consumption. When these conditions were actually measured, the toner accumulated so as to form the toner layer that hampers the supply of the developer at a moment of time when the toner consumption was 1% and the temperature within the developing container 2 increased to 45 degree Celsius. This corresponds to a time taken to continuously print out recording media corresponding to 5,000 to 5,500 sheets of A4 size sheet. Then, setting a threshold value of the executing timing of the developer overflow restraining control at 5,000 sheets, the respective embodiments described above are arranged to execute the developer overflow restraining control when the cumulative number of sheets reaches 5,000 sheets and to successively execute the conveyance failure preventing control.

However, a time taken for the toner layer hampering the supply of the developer to be formed changes depending on the conditions of the developer within the developing container 2. For example, in a case when the temperature of the developer within the developing container 2 is high, the toner layer is formed to a degree of hampering the supply of the developer in a short time as compared to a case when the temperature is low. Still further, in a case when a toner average stay time is long, i.e., in a case when the developer within the developing container 2 receives much load, thus changing its toner characteristic, and an operation of forming images whose average printing rate is low continues for a long period of time, a toner layer is formed in a short time as compared to a case when the toner average stay time is short. Therefore, there is a possibility that the conveyance failure preventing control is executed in a timing earlier than what is necessary when the supply of the developer is actually hampered by the execution timing based on the cumulative number of sheets of 5,000 sheets described above. This may result in executing the conveyance failure preventing control by plural times in executing the image forming job, increasing a down time. Then, it is necessary to adjust the execution timing of the developer overflow restraining control and also of the conveyance failure preventing control corresponding to the conditions of the developer.

The following is one method for adjusting the execution timing. That is, a number of output sheets per every image forming job is obtained by multiplying a number of printed sheets with an index determined by temperature, average printing rate (average imaging ratio), size of a recording medium or the like in forming an image and the cumulative number of sheets is calculated by accumulating the number of the output sheets. The cumulative number of sheets is compared with the threshold value in updating its number. Table 6 shows the indices to be multiplied. In view of the time taken to form the toner layer that hampers the supply of the developer varies depending on the toner characteristic and the temperature of the developer, the indices shown in Table 6 are weighting indices corresponding to the temperature of the developer and the average printing rate. This is what the change of the toner characteristic is estimated by the average printing rate of recording media of a plurality of sheets, e.g., 1,000 sheets, printed out in the past. As shown in Table 6, in a case when the temperature of the developer is 48 degree Celsius and the average printing rate is 1% for example, '1.0' is multiplied with the printed number of sheets in the printing job. In a case when the temperature of the developer is 42 degree Celsius and the average printing rate is 3%, '0.8' is multiplied with the printed number of sheets. In a case when the temperature of the developer is 38 degree Celsius and the average printing rate is 10%, '0.5' is multiplied with the printed number of sheets.

TABLE 6

| TABLE OF INDICE (A4 STANDARD) | | TEMPERATURE 40° C. OR LESS | 40 TO 45° C. | 45° C. OR MORE |
|---|---|---|---|---|
| AVERAGE PRINTING RATE | 5% OR MORE | 0.5 | 0.8 | 0.8 |
| | 2 TO 5% | 0.8 | 0.8 | 1.0 |
| | 1 TO 2% | 0.8 | 1.0 | 1.0 |

The specific control related to the execution timing of the developer overflow restraining control will be described below. That is, the control portion 500 calculates the average printing rate as a change of the toner characteristics. For instance, the control portion 500 detects a number of dots of an electrostatic image formed on the photosensitive drum 101 by an image dot counting portion not shown and calculates the average printing rate based on the detected result. It is noted that, the average printing rate may be obtained by other well-known methods. In addition, the control portion 500 obtains the temperature of the developer from a developer temperature detecting sensor 601 (see FIG. 2) provided within the developing container 2 (specifically, within the recovery chamber 403). Then, in accordance to the calculated average printing rate and the temperature of the developer, the control portion 500 updates the cumulative number of sheets multiplied by a corresponding weighting index by making reference to an index table corresponding to Table 6 stored within a memory or the like not shown. The control portion 500 judges whether or not the developer overflow restraining control should be executed based on the obtained cumulative number of sheets.

As described above, the control portion 500 judges whether or not the developer overflow restraining control should be executed based on whether or not the cumulative number of sheets has reached the predetermined number, e.g., 5,000 sheets, for example. The control portion 500 judges that based on the cumulative number of sheets when the cumulative number of sheets is found by multiplying the weighting index. That is, in a case when the temperature of the developer is 48 degree Celsius and the average printing rate is 1% for example, the cumulative number of sheets found by repeating the image forming operation by 5,000 times by multiplying the weighting index results in 5,000 (1×5,000) sheets. Accordingly, in this case, the control portion 500 executes the developer overflow restraining control every time when the image forming operation is repeated by 5,000 times.

Meanwhile, in a case when the temperature of the developer is 42 degree Celsius and the average printing rate is 3%, the cumulative number of sheets found by repeating the image forming operation by 5,000 times by multiplying the weighting index results in 4,000 (0.8 ×5,000) sheets. That is, in this case, the cumulative number of sheets does not reach the threshold value even if the control portion 500 repeats the image forming operation 5,000 times. In this case, the cumulative number of sheets reaches the threshold value of 5,000 sheets by repeating the image forming operation by 6,250 times (0.8×6,250). Accordingly, in this case, the control portion 500 executes the developer overflow restraining control every time when the image forming operation is repeated by 6,250 times. Table 7 shows the execution timing of the developer overflow restraining control corresponding to the respective conditions (the combinations of the temperature of the developer and the average printing rate) corresponding to Table 6. Thus, the execution timing of the developer overflow restraining control and also the conveyance failure preventing control is variably adjusted corresponding to the conditions of the developer.

TABLE 7

| EXECUTION TIMING (A4 STANDARD) | | TEMPERATURE 40° C. OR LESS | 40 TO 45° C. | 45° C. OR MORE |
|---|---|---|---|---|
| AVERAGE PRINTING RATE | 5% OR MORE | PER 10,000 SHEETS | PER 6,250 SHEETS | PER 6,250 SHEETS |
| | 2 TO 5% | PER 6,250 SHEETS | PER 6,250 SHEETS | PER 5,000 SHEETS |
| | 1 TO 2% | PER 6,250 SHEETS | PER 5,000 SHEETS | PER 5,000 SHEETS |

It is noted that while the case in which the agitating screw 32 is also driven when the developing screw 31 is driven has been exemplified in each embodiment described above, the present invention is not limited to such configuration and may be arranged such that the developing and agitating screws 31 and 32 can be separately driven. The developing and agitating screws 31 and 32 are driven at same speed also in this case.

It is also noted that while the vertical agitating type developing apparatus in which the developing container 2 is partitioned vertically as the supply chamber 401 and the recovery chamber 403 has been exemplified in each embodiment described above, the present invention is not limited to such configuration. That is, the present invention is applicable also to a configuration in which the supply and recovery chambers 401 and 403 are parted in a horizontal direction and the functions are separated to the chamber supplying the developer and to the chamber recovering the developer from the developing sleeve 6. Still further, while the discharge port for overflowing the developer is provided in the supply chamber, it may be provided in the recovery chamber.

It is further noted that the case of executing the conveyance failure preventing control per every predetermined number of sheets has been exemplified in each embodiment described above, it is also possible, if the cumulative number of sheets is close to the predetermined number of sheets, to arrange such that the conveyance failure preventing control is executed during post-rotation. This arrangement makes it possible to control the down-time.

Still further, in a case where the timing of executing the conveyance failure preventing control comes to either one color developing apparatus among the respective color developing apparatuses, it is also possible to arrange to execute the conveyance failure preventing control simultaneously, even if it is not a timing of executing the conveyance failure preventing control of the other color developing apparatus, if it is close to the execution timing. Still further, the inventions described in the embodiments described above may be combined in any manner. The embodiments described above are merely exemplary embodiments of the invention, and the present invention is not limited to them.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

This application claims the benefit of Japanese Patent Application No. 2014-107571, filed on May 23, 2014 and of Japanese Patent Application No. 2014-107574, filed on May 23, 2014, and are hereby incorporated by reference herein in their entirety.

The invention claimed is:

1. An image forming apparatus, comprising:

an image forming portion configured to form images on recording media, the image forming portion including:

a developer bearing member configured to bear developer and carry the developer by rotating;

a first chamber configured to supply the developer to the developer bearing member;

a second chamber configured to recover the developer from the developer bearing member without causing the developer to pass through the first chamber, and configured to communicate with the first chamber to form a circulating route of the developer;

a first feeding member configured to feed the developer in the first chamber; and a second feeding member configured to feed the developer in the second chamber; and a control portion configured to execute a plurality of modes by suspending an image forming operation when an image forming job of forming images on the recording media continuously is carried out, the plurality of modes including:

(i) a first mode of circulating the developer in the circulating route in a condition in which a ratio of a rotational speed of the developer bearing member to a rotational speed of the first and second feeding members is decreased as compared to that in forming the images; and (ii) a second mode of increasing the ratio of the rotational speed of the developer bearing member to the rotational speed of the first feeding member as compared to that in forming the images, the second mode being executed after the first mode and before resuming the image forming operation.

2. The image forming apparatus according to claim 1, wherein the plurality of modes includes a third mode of driving the first and second feeding members and the developer bearing member at speeds lower than those in forming the images, the third mode being executed after the second mode and before resuming the image forming operation.

3. The image forming apparatus according to claim 1, wherein the first mode is executed in a case when a number of sheets of the recording media on which the images have been formed since a previous execution of the plurality of modes reaches a threshold value or more, in a case when a time during which the images have been formed reaches a threshold value or more, or in a case when a number of rotations of the developer bearing member reaches a threshold value or more.

4. The image forming apparatus according to claim 3, further comprising a developer temperature detecting portion detecting temperature of the developer in the circulating route, wherein the control portion finds an average image ratio of a plurality of sheets of the recording media on which images have been formed in an image forming operation, and based on the average image ratio and the temperature of the developer detected by the developer temperature detecting portion, changes the number of sheets of the recording media on which the images have been formed since the previous execution of the plurality of modes, the time during which the images have been formed, or the number of rotations of the developer bearing member.

5. The image forming apparatus according to claim 1, further comprising:

a regulating member disposed to face the developer bearing member and regulating the developer carried on the developer bearing member; and a back-up member forming a buffer portion temporarily storing the developer between the first chamber and the regulating member, wherein the control portion executes the second mode such that an amount of the developer corresponding to at least to 50% of a volume of the buffer portion is conveyed to the second chamber.

6. The image forming apparatus according to claim 1, the control portion driving the first and second feeding members at speeds lower than those in forming the images in the first mode.

* * * * *